US009016376B2

(12) United States Patent
Surjaatmadja et al.

(10) Patent No.: US 9,016,376 B2
(45) Date of Patent: Apr. 28, 2015

(54) METHOD AND WELLBORE SERVICING APPARATUS FOR PRODUCTION COMPLETION OF AN OIL AND GAS WELL

(75) Inventors: Jim B. Surjaatmadja, Duncan, OK (US); KingKwee Chong, Duncan, OK (US); Billy W. McDaniel, Duncan, OK (US); Loyd E. East, Tomball, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 368 days.

(21) Appl. No.: 13/567,953

(22) Filed: Aug. 6, 2012

(65) Prior Publication Data

US 2014/0034319 A1 Feb. 6, 2014

(51) Int. Cl.

| | |
|---|---|
| ***E21B 43/14*** | (2006.01) |
| ***E21B 34/10*** | (2006.01) |
| ***E21B 43/26*** | (2006.01) |
| ***E21B 43/16*** | (2006.01) |

(52) U.S. Cl.

CPC ..... *E21B 43/14* (2013.01); *E21B 34/10* (2013.01); *E21B 43/261* (2013.01); *E21B 43/162* (2013.01); *E21B 43/26* (2013.01)

(58) Field of Classification Search

CPC . E21B 2034/007; E21B 34/10; E21B 43/045; E21B 43/26; E21B 43/261; E21B 43/04; E21B 43/267

USPC ..... 166/278, 280.1, 283, 285, 300, 308.1, 166/305.1, 373, 386, 387, 318

See application file for complete search history.

(56) References Cited

U.S. PATENT DOCUMENTS

| | | | |
|---|---|---|---|
| 2,312,018 | A | 2/1943 | Beckman |
| 2,753,940 | A | 7/1956 | Bonner |
| 3,912,692 | A | 10/1975 | Casey et al. |
| 4,005,750 | A | 2/1977 | Shuck |
| 4,312,406 | A | 1/1982 | McLaurin et al. |
| 4,387,769 | A | 6/1983 | Erbstoesser et al. |
| 4,509,598 | A | 4/1985 | Earl et al. |
| 4,515,214 | A | 5/1985 | Fitch et al. |

(Continued)

FOREIGN PATENT DOCUMENTS

| | | | |
|---|---|---|---|
| CA | 2734351 | A1 | 2/2010 |
| WO | 03072907 | A1 | 9/2003 |

(Continued)

OTHER PUBLICATIONS

Office Action dated Jun. 11, 2014 (66 pages), U.S. Appl. No. 12/358,079, filed Jan. 22, 2009.

(Continued)

*Primary Examiner* — Cathleen Hutchins

(74) *Attorney, Agent, or Firm* — John W. Wustenberg; Baker Botts L.L.P.

(57) ABSTRACT

A method of servicing a subterranean formation comprising placing a wellbore servicing system within a wellbore penetrating the subterranean formation, wherein the wellbore servicing system comprises a first activatable stimulation assembly and a second activatable stimulation assembly incorporated within a tubular string, configuring the wellbore servicing system to provide a route of fluid communication from the first activatable stimulation assembly to a first zone of the subterranean formation, introducing a treatment fluid into the first zone of the subterranean formation via the first activatable stimulation assembly, and embedding a first portion of the wellbore servicing system within the wellbore.

25 Claims, 11 Drawing Sheets

(56) References Cited

U.S. PATENT DOCUMENTS 4,590,995 A 5/1986 Evans
4,687,061 A 8/1987 Uhri
4,869,322 A 9/1989 Vogt, Jr. et al.
4,887,670 A 12/1989 Lord et al.
5,074,360 A 12/1991 Guinn
5,111,881 A 5/1992 Soliman et al.
5,145,004 A * 9/1992 Cornette ..... 166/278
5,216,050 A 6/1993 Sinclair
5,241,475 A 8/1993 Lee et al.
5,318,123 A 6/1994 Venditto et al.
2,703,316 A 3/1995 Schneider
5,482,116 A 1/1996 El-Rabaa et al.
5,494,103 A 2/1996 Surjaatmadja et al.
5,499,678 A 3/1996 Surjaatmadja et al.
5,533,571 A 7/1996 Surjaatmadja et al.
5,547,023 A 8/1996 McDaniel et al.
5,595,245 A 1/1997 Scott, III
5,765,642 A 6/1998 Surjaatmadja
6,047,773 A 4/2000 Zeltmann et al.
6,283,210 B1 9/2001 Soliman et al.
6,323,307 B1 11/2001 Bigg et al.
6,394,184 B2 5/2002 Tolman et al.
6,401,815 B1 6/2002 Surjaatmadja et al.
6,439,310 B1 8/2002 Scott, III et al.
6,474,419 B2 11/2002 Maier et al.
6,543,538 B2 4/2003 Tolman et al.
6,565,129 B2 5/2003 Surjaatmadja
6,662,874 B2 12/2003 Surjaatmadja et al.
6,719,054 B2 4/2004 Cheng et al.
6,725,933 B2 4/2004 Middaugh et al.
6,779,607 B2 8/2004 Middaugh et al.
6,805,199 B2 10/2004 Surjaatmadja
6,837,523 B2 1/2005 Surjaatmadja et al.
6,907,936 B2 6/2005 Fehr et al.
6,938,690 B2 9/2005 Surjaatmadja
7,032,671 B2 4/2006 Aud
7,044,220 B2 5/2006 Nguyen et al.
7,059,407 B2 6/2006 Tolman et al.
7,066,265 B2 6/2006 Surjaatmadja
7,090,153 B2 8/2006 King et al.
7,096,954 B2 8/2006 Weng et al.
7,100,688 B2 9/2006 Stephenson et al.
7,108,064 B2 9/2006 Hart et al.
7,108,067 B2 9/2006 Themig et al.
7,150,327 B2 12/2006 Surjaatmadja
7,152,677 B2 12/2006 Parlar et al.
7,159,660 B2 1/2007 Justus
7,225,869 B2 6/2007 Willett et al.
7,228,908 B2 6/2007 East, Jr. et al.
7,234,529 B2 6/2007 Surjaatmadja
7,237,612 B2 7/2007 Surjaatmadja et al.
7,243,723 B2 7/2007 Surjaatmadja et al.
7,273,099 B2 9/2007 East, Jr. et al.
7,273,313 B2 9/2007 Surjaatmadja
7,278,486 B2 10/2007 Alba et al.
7,281,581 B2 10/2007 Nguyen et al.
7,287,592 B2 10/2007 Surjaatmadja et al.
7,296,625 B2 11/2007 East, Jr.
7,318,473 B2 1/2008 East, Jr. et al.
7,322,417 B2 1/2008 Rytlewski et al.
7,325,608 B2 2/2008 van Batenburg et al.
7,337,844 B2 3/2008 Surjaatmadja et al.
7,343,975 B2 3/2008 Surjaatmadja et al.
7,370,701 B2 5/2008 Surjaatmadja et al.
7,387,165 B2 6/2008 Lopez de Cardenas et al.
7,398,825 B2 7/2008 Nguyen et al.
7,429,332 B2 9/2008 Surjaatmadja et al.
7,431,090 B2 10/2008 Surjaatmadja et al.
7,445,045 B2 11/2008 East, Jr. et al.
7,472,746 B2 1/2009 Maier
7,478,020 B2 1/2009 Guo et al.
7,478,676 B2 1/2009 East, Jr. et al.
7,503,404 B2 3/2009 McDaniel et al.
7,506,689 B2 3/2009 Surjaatmadja et al.
7,520,327 B2 4/2009 Surjaatmadja
7,543,635 B2 6/2009 East et al.
7,571,766 B2 8/2009 Pauls et al.
7,571,767 B2 8/2009 Parker et al.
7,575,062 B2 8/2009 East, Jr.
7,580,796 B2 8/2009 Soliman et al.
7,595,281 B2 9/2009 McDaniel et al.
7,610,959 B2 11/2009 Surjaatmadja
7,617,871 B2 11/2009 Surjaatmadja et al.
7,625,846 B2 12/2009 Cooke, Jr.
7,647,964 B2 1/2010 Akbar et al.
7,673,673 B2 3/2010 Surjaatmadja et al.
7,681,645 B2 3/2010 McMillin et al.
7,690,427 B2 4/2010 Rispler
7,703,510 B2 4/2010 Xu
7,711,487 B2 5/2010 Surjaatmadja
7,723,264 B2 5/2010 McDaniel et al.
7,726,403 B2 6/2010 Surjaatmadja
7,730,951 B2 6/2010 Surjaatmadja et al.
7,740,072 B2 6/2010 Surjaatmadja
7,766,083 B2 8/2010 Willett et al.
7,775,278 B2 8/2010 Willberg et al.
7,775,285 B2 8/2010 Surjaatmadja et al.
7,841,396 B2 11/2010 Surjaatmadja
7,849,924 B2 12/2010 Surjaatmadja et al.
7,861,788 B2 1/2011 Tips et al.
7,870,907 B2 1/2011 Lembcke et al.
7,874,365 B2 1/2011 East, Jr. et al.
7,882,894 B2 2/2011 Nguyen et al.
7,905,284 B2 3/2011 Ross et al.
7,926,571 B2 4/2011 Hofman
7,931,082 B2 4/2011 Surjaatmadja
7,946,340 B2 5/2011 Surjaatmadja et al.
7,963,331 B2 6/2011 Surjaatmadja et al.
7,971,646 B2 7/2011 Murray et al.
8,016,032 B2 9/2011 Mandrell et al.
8,056,638 B2 11/2011 Clayton et al.
8,061,426 B2 11/2011 Surjaatmadja
8,066,068 B2 11/2011 Lesko et al.
8,074,715 B2 12/2011 Rispler et al.
8,079,933 B2 12/2011 Kaminsky et al.
8,096,358 B2 1/2012 Rispler et al.
8,104,535 B2 1/2012 Sierra et al.
8,104,539 B2 1/2012 Stanojcic et al.
8,126,689 B2 2/2012 Soliman et al.
8,210,257 B2 7/2012 Dusterhoft et al.
8,267,172 B2 9/2012 Surjaatmadja et al.
8,307,893 B2 11/2012 Sierra et al.
8,307,904 B2 11/2012 Surjaatmadja
2006/0070740 A1 4/2006 Surjaatmadja et al.
2006/0086507 A1 4/2006 Surjaatmadja et al.
2007/0102156 A1 5/2007 Nguyen et al.
2007/0261851 A1 11/2007 Surjaatmadja
2007/0284106 A1 12/2007 Kalman et al.
2007/0295506 A1 12/2007 Li et al.
2008/0000637 A1 1/2008 McDaniel et al.
2008/0060810 A9 3/2008 Nguyen et al.
2008/0135248 A1 6/2008 Talley et al.
2009/0062157 A1 3/2009 Munoz, Jr. et al.
2009/0125280 A1 5/2009 Soliman et al.
2009/0139728 A1 * 6/2009 Schrader et al. ..... 166/373
2009/0288833 A1 11/2009 Graham et al.
2009/0308588 A1 12/2009 Howell et al.
2010/0000727 A1 1/2010 Webb et al.
2010/0044041 A1 2/2010 Smith et al.
2010/0243253 A1 9/2010 Surjaatmadja et al.
2011/0017458 A1 1/2011 East, Jr. et al.
2011/0028358 A1 2/2011 Welton et al.
2011/0067870 A1 3/2011 East, Jr.
2011/0284214 A1 11/2011 Ayoub et al.
2012/0118568 A1 5/2012 Kleefisch et al.
2012/0152550 A1 6/2012 East, Jr.

FOREIGN PATENT DOCUMENTS

WO 2008027982 A2 3/2008
WO 2008139132 A1 11/2008
WO 2010020747 A2 2/2010

(56) References Cited

FOREIGN PATENT DOCUMENTS

| | | | |
|---|---|---|---|
| WO | 2010020747 | A3 | 2/2010 |
| WO | 2011010113 | A2 | 1/2011 |
| WO | 2011010113 | A3 | 1/2011 |

OTHER PUBLICATIONS

Office Action dated Nov. 20, 2013 (31 pages), U.S. Appl. No. 13/892,710, filed May 13, 2013.
Foreign communication from a related counterpart application—International Preliminary Report on Patentability, PCT/GB2009/001904, Apr. 19, 2011, 7 pages.
Foreign communication from a related counterpart application—International Search Report and Written Opinion, PCT/GB2010/001407, Mar. 23, 2011, 10 pages.
Filing receipt and specification for patent application entitled "Wellbore Servicing Fluids and Methods of Making and Using Same," by Neil Joseph Modeland, filed Jan. 30, 2013 as U.S. Appl. No. 13/754,397.
Office Action dated May 16, 2013 (26 pages), U.S. Appl. No. 12/686,116, filed Jan. 12, 2010.
Filing receipt and specification for patent application entitled "Method for Inducing Fracture Complexity in Hydraulically Fractured Horizontal Well Completions," by Loyd E East, Jr., et al., filed May 13, 2013 as U.S. Appl. No. 13/892,710.
Advances in Polymer Science, Author Index vols. 101-157 and Subject Index, 2002, 17 pages, Springer-Verlag Berlin Heidelberg.
Advances in Polymer Science, vol. 157, "Degradable Aliphatic Polyesters," 2002, 10 pages of Content and Publishing Information, Springer-Verlag Berlin Heidelberg.
Albertsson, Ann-Christine, et al., "Aliphatic Polyesters: Synthesis, Properties and Applications," Chapter 1 of Advances in Polymer Science, 2002, pp. 1-40, vol. 157, Springer-Verlag Berlin Heidelberg.
Baski brochure entitled, "Packers: general information," http://www.baski.com/packer.htm, Dec. 16, 2009, 4 pages, Baski, Inc.
Cipolla, C. L., et al., "The relationship between fracture complexity, reservoir properties, and fracture treatment design," SPE 115769, 2008, pp. 1-25, Society of Petroleum Engineers.
Edlund, U., et al., "Degradable Polymer Microspheres for Controlled Drug Delivery," Chapter 3 of Advances in Polymer Science, 2002, pp. 67-112, vol. 157, Springer-Verlag Berlin Heidelberg.
Foreign communication from a related counterpart application—Canadian Office Action, CA 2,734,351, Jun. 19, 2012, 2 pages.
Foreign communication from a related counterpart application—International Search Report and Written Opinion, PCT/GB2009/001904, Apr. 13, 2011, 10 pages.
Foreign communication from a related counterpart application—International Preliminary Report on Patentability, PCT/GB2010/001407, Jan. 24, 2012, 8 pages.
Hakkarainen, Minna, "Aliphatic Polyesters: Abiotic and Biotic Degradation and Degradation Products," Chapter 4 of Advances in Polymer Science, 2002, pp. 113-138, vol. 157, Springer-Verlag Berlin Heidelberg.
Halliburton brochure entitled "Cobra Frac® service," Oct. 2004, 2 pages, Halliburton.
Halliburton brochure entitled "Cobra Frac® H service," Mar. 2009, 2 pages, Halliburton.
Halliburton brochure entitled "Cobra Frac® H service," Sep. 2009, 2 pages, Halliburton.
Halliburton brochure entitled "CobraMax® DM Service," Jul. 2011, 2 pages, Halliburton.
Halliburton brochure entitled "Delta Stim™ sleeve," Mar. 2007, 2 pages, Halliburton.
Halliburton brochure entitled "EquiFlow™ inflow control devices," Jan. 2008, 2 pages, Halliburton.
Halliburton brochure entitled, "RDT™—oval pad and straddle packer," Feb. 2008, 2 pages, Halliburton.
Halliburton brochure entitled, "Swellpacker™ cable system," 2009, 2 pages, Halliburton.
Halliburton HT-400 pump maintenance and repair manual, Jun. 1997, pp. 1-14, 1-15, 5-12 to 5-15, and 7-106 to 7-109, Halliburton.
Kundert, Donald, et al., "Proper evaluation of shale gas reservoirs leads to a more effective hydraulic-fracture stimulation," SPE 123586, 2009, pp. 1-11, Society of Petroleum Engineers.
Lindsay, S. et al., "Downhole Mixing Fracturing Method Using Coiled Tubing Efficiently: Executed in the Eagle Ford Shale," SPE 153312, 2012, pp. 1-14, Society of Petroleum Engineers.
Lindblad, Margaretha Söderqvist, et al., "Polymers from Renewable Resources" Chapter 5 of Advances in Polymer Science, 2002, pp. 139-161, vol. 157, Springer-Verlag Berlin Heidelberg.
Mullen, Mike, et al., A composite determination of mechanical rock properties for stimulation design (what to do when you don't have a sonic log), SPE 108139, 2007, pp. 1-13, Society of Petroleum Engineers.
Norris, M. R., et al., "Multiple proppant fracturing of horizontal wellbores in a chalk formation: evolving the process in the Valhall Field," SPE 50608, 1998, pp. 335-349, Society of Petroleum Engineers, Inc.
Office Action dated Oct. 8, 2010 (17 pages), U.S. Appl. No. 12/358,079, filed Jan. 22, 2009.
Office Action dated Apr. 28, 2010 (22 pages), U.S. Appl. No. 12/358,079, filed Jan. 22, 2009.
Office Action dated Apr. 4, 2011 (12 pages), U.S. Appl. No. 12/358,079, filed Jan. 22, 2009.
Office Action (Final) dated Oct. 19, 2011 (12 pages), U.S. Appl. No. 12/358,079, filed Jan. 22, 2009.
Advisory Action dated Dec. 7, 2011 (2 pages), U.S. Appl. No. 12/358,079, filed Jan. 22, 2009.
Office Action dated Sep. 28, 2011 (27 pages), U.S. Appl. No. 12/566,467, filed Sep. 24, 2009.
Office Action (Final) dated Jan. 26, 2012 (22 pages), U.S. Appl. No. 12/566,467, filed Sep. 24, 2009.
Advisory Action dated Mar. 30, 2012 (3 pages), U.S. Appl. No. 12/566,467, filed Sep. 24, 2009.
Office Action dated Dec. 6, 2012 (24 pages), U.S. Appl. No. 12/566,467, filed Sep. 24, 2009.
Office Action dated May 23, 2012 (43 pages), U.S. Appl. No. 12/686,116, filed Jan. 12, 2010.
Office Action (Final) dated Oct. 29, 2012 (17 pages), U.S. Appl. No. 12/686,116, filed Jan. 12, 2010.
Advisory Action dated Jan. 2, 2013 (4 pages), U.S. Appl. No. 12/686,116, filed Jan. 12, 2010.
Filing receipt and patent application entitled "Multi-Interval Wellbore Treatment Method," by Loyd Eddie East, et al., filed Apr. 9, 2012 as U.S. Appl. No. 13/442,411.
Filing receipt and provisional patent application entitled "High rate stimulation method for deep, large bore completions," by Malcolm Joseph Smith, et al., filed Aug. 22, 2008 as U.S. Appl. No. 61/091,229.
Filing receipt and provisional patent application entitled "Method for inducing fracture complexity in hydraulically fractured horizontal well completions," by Loyd E. East, Jr., et al., filed Jul. 24, 2009 as U.S. Appl. No. 61/228,494.
Filing receipt and provisional patent application entitled "Method for inducing fracture complexity in hydraulically fractured horizontal well completions," by Loyd E. East, Jr., et al., filed Sep. 17, 2009 as U.S. Appl. No. 61/243,453.
Ramurthy, Muthukumarappan, et al., "Effects of high-pressure-dependent leakoff and high-process-zone stress in coal stimulation treatments," SPE 107971, 2007, pp. 1-8, Society of Petroleum Engineers.
Rickman, Rick, et al., "A practical use of shale petrophysics for stimulation design optimization: all shale plays are not clones of the Barnett Shale," SPE 115258, 2008, pp. 1-11, Society of Petroleum Engineers.
Sneddon, I. N., "The distribution of stress in the neighbourhood of a crack in an elastic solid," Proceedings of the Royal Society of London; Series A, Mathematical and Physical Sciences, Oct. 22, 1946, pp. 229-260, vol. 187, No. 1009, The Royal Society.
Sneddon, I. N., et al., "The opening of a Griffith crack under internal pressure," 1946, p. 262-267, vol. 4, No. 3, Quarterly of Applied Mathematics.

(56) References Cited

OTHER PUBLICATIONS

Soliman, M. Y., et al., "Effect of friction and leak-off on fracture parameters calculated from hydraulic impedance testing," SPE 39529, 1998, pp. 245-251, Society of Petroleum Engineers, Inc.
Soliman, M. Y., et al., "GeoMechanics aspects of multiple fracturing of horizontal and vertical wells," SPE 86992, 2004, pp. 1-15, Society of Petroleum Engineers Inc.
Soliman, M. Y., et al., "Geomechanics aspects of multiple fracturing of horizontal and vertical wells," SPE 86992, SPE Drilling and Completion, Sep. 2008, pp. 217-228, Society of Petroleum Engineers.
Stridsberg, Kajsa M., et al., "Controlled Ring-Opening Polymerization: Polymers with designed Macromolecular Architecture," Chapter 2 of Advances in Polymer Science, 2002, pp. 41-65, vol. 157, Springer-Verlag Berlin Heidelberg.
Warpinski, N.R., et al., "Mapping hydraulic fracture growth and geometry using microseismic events detected by a wireline retrievable accelerometer array," SPE 40014, 1998, pp. 335-346, Society of Petroleum Engineers.
Waters, George, et al., "Simultaneous hydraulic fracturing of adjacent horizontal wells in the Woodford Shale," SPE 119635, 2009, pp. 1-22, Society of Petroleum Engineers.
Filing receipt and specification for patent application entitled "Complex Fracturing Using a Straddle Packer in a Horizontal Wellbore," by Loyd E East, Jr., filed Dec. 13, 2013 as U.S. Appl. No. 14/106,323.
Foreign communication from a related counterpart application—International Search Report and Written Opinion, PCT/US2013/030784, May 9, 2014, 9 pages.
Office Action dated May 16, 2014 (54 pages), U.S. Appl. No. 13/442,411, filed Apr. 9, 2012.

* cited by examiner

METHOD AND WELLBORE SERVICING APPARATUS FOR PRODUCTION COMPLETION OF AN OIL AND GAS WELL

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Hydrocarbon-producing wells often are stimulated by hydraulic fracturing operations, wherein a servicing fluid such as a fracturing fluid or a perforating fluid may be introduced into a portion of a subterranean formation penetrated by a wellbore at a hydraulic pressure sufficient to create or enhance at least one fracture therein. Such a subterranean formation stimulation treatment may increase hydrocarbon production from the well.

In some wellbores, it may be desirable to selectively create multiple fractures along a wellbore at a distance apart from each other, for example, thereby stimulating multiple "pay zones." The multiple fractures should each have adequate conductivity, so that the greatest possible quantity of hydrocarbons in an oil and gas reservoir can be produced from the wellbore. Some pay zones may extend a substantial distance along the length of a wellbore.

In order to adequately induce the formation of fractures within such zones in an efficient manner, it may be advantageous to introduce a stimulation fluid into the formation via a plurality of points of entry positioned along the wellbore and adjacent to multiple zones of the formation. Individually treating each zone can be time-consuming and may necessitate additional equipment, for example, to isolate points of entry adjacent to the point of entry utilized to treat a particular zone.

After the formation and/or one or more zones thereof have been stimulated a route of fluid communication from the formation to the surface must be provided, for example, for the production of formation fluids.

However, conventional servicing equipment and/or methods of using the same in the performance of a servicing operation have proven inadequate in many situations. As such, there exists a need for a method and the associated equipment that will allow an operator to introduce a stimulation fluid into a formation and/or one or more zones thereof, for example, to create fractures while assuring adequate distribution of treatment fluid and, thereafter, to provide a route of fluid communication for the production of formation fluids. Particularly, there exists a need for methods, and the equipment utilized in the performance of such methods, that will allow an operator to both stimulate a formation and produce therefrom, for example with a single apparatus.

SUMMARY

Disclosed herein is a method of servicing a subterranean formation comprising placing a wellbore servicing system within a wellbore penetrating the subterranean formation, wherein the wellbore servicing system comprises a first activatable stimulation assembly and a second activatable stimulation assembly incorporated within a tubular string, configuring the wellbore servicing system to provide a route of fluid communication from the first activatable stimulation assembly to a first zone of the subterranean formation, introducing a treatment fluid into the first zone of the subterranean formation via the first activatable stimulation assembly, and embedding a first portion of the wellbore servicing system within the wellbore.

Also disclosed herein is a wellbore servicing system comprising a wellbore servicing system positioned within a wellbore penetrating a subterranean formation, wherein the wellbore servicing system comprises a first activatable stimulation assembly and a second activatable stimulation assembly incorporated within a tubular string, a pack of particulate material disposed within at least a portion of an annular space surrounding the wellbore servicing system, wherein the pack of particulate material is effective to secure the wellbore servicing system within the wellbore, to at least substantially obstruct fluid communication via a the annual space, or combinations thereof.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
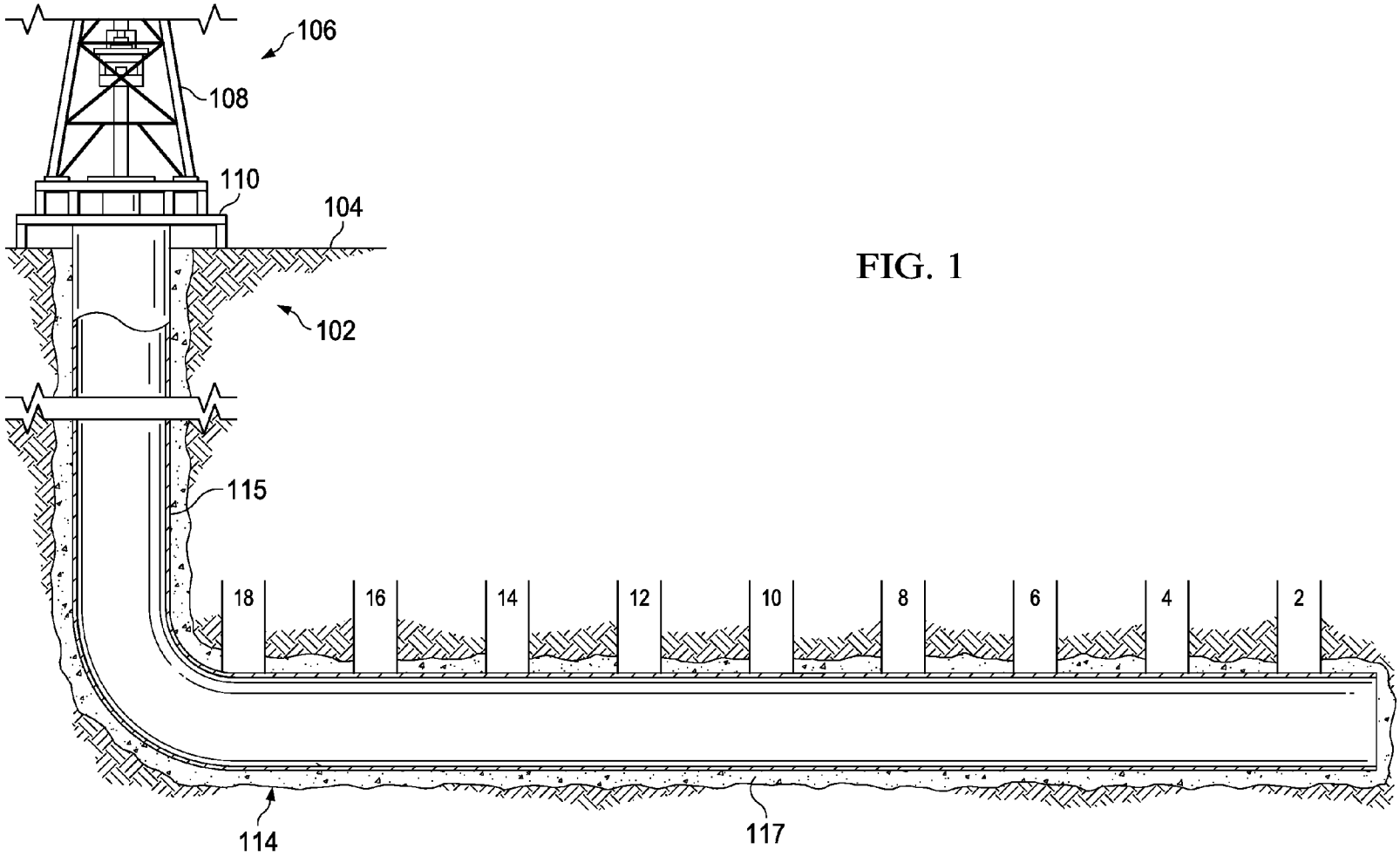
FIG. 1 is partial cut-away view of an embodiment of an environment in which a wellbore servicing system and a method of using such a wellbore servicing system may be employed.

In the drawings and description that follow, like parts are typically marked throughout the specification and drawings with the same reference numerals, respectively. In addition, similar reference numerals may refer to similar components in different embodiments disclosed herein. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is not intended to limit the invention to the embodiments illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "up-hole," "upstream," or other like terms shall be construed as generally from the formation toward the surface or toward the surface of a body of water; likewise, use of "down," "lower," "downward," "down-hole," "downstream," or other like terms shall be construed as generally into the formation away from the surface or away from the surface of a body of water, regardless of the wellbore orientation. Use of any one or more of the foregoing terms shall not be construed as denoting positions along a perfectly vertical axis.

Unless otherwise specified, use of the term "subterranean formation" shall be construed as encompassing both areas below exposed earth and areas below earth covered by water such as ocean or fresh water.

Disclosed herein are embodiments of wellbore servicing methods, as well as apparatuses and systems that may be utilized in performing the same. Particularly, disclosed herein are one or more embodiments of a wellbore servicing system comprising one or more activatable stimulation assemblies (ASAs) configured for selective activation and methods of utilizing the same in servicing and/or completing a wellbore. In an embodiment, the wellbore servicing system and/or methods of utilizing the same, as will be disclosed herein, may allow an operator to treat (e.g., stimulate), such as by perforating and/or fracturing, one or more zones of a subterranean formation and to produce a formation fluid therefrom.

Referring to FIG. 1, an embodiment of an operating environment in which such a wellbore servicing system and/or method may be employed is illustrated. It is noted that although some of the figures may exemplify horizontal or vertical wellbores, the principles of the methods, apparatuses, and systems disclosed herein may be similarly applicable to horizontal wellbore configurations, conventional vertical wellbore configurations, or combinations thereof. Therefore, unless otherwise noted, the horizontal or vertical nature of any figure is not to be construed as limiting the wellbore to any particular configuration.

Referring to the embodiment of FIG. 1, the operating environment generally comprises a wellbore 114 that penetrates a subterranean formation 102 comprising a plurality of formation zones 2, 4, 6, 8, 10, 12, 14, 16, and 18 for the purpose of recovering hydrocarbons, storing hydrocarbons, disposing of carbon dioxide, or the like. The wellbore 114 may be drilled into the subterranean formation 102 using any suitable drilling technique. In an embodiment, a drilling or servicing rig 106 comprises a derrick 108 with a rig floor 110 through which one or more tubular strings (e.g., a work string, a drill string, a tool string, a segmented tubing string, a jointed tubing string, or any other suitable conveyance, or combinations thereof) generally defining an axial flowbore may be positioned within or partially within the wellbore 114. In an embodiment, such a tubular string may comprise two or more concentrically positioned strings of pipe or tubing (e.g., a first work string may be positioned within a second work string). The drilling or servicing rig 106 may be conventional and may comprise a motor driven winch and other associated equipment for lowering the work string into the wellbore 114. Alternatively, a mobile workover rig, a wellbore servicing unit (e.g., coiled tubing units), or the like may be used to lower the tubular string into the wellbore 114. In such an embodiment, the tubular string may be utilized in drilling, stimulating, completing, or otherwise servicing the wellbore, or combinations thereof.

The wellbore 114 may extend substantially vertically away from the earth's surface over a vertical wellbore portion, or may deviate at any angle from the earth's surface 104 over a deviated or horizontal wellbore portion. In alternative operating environments, portions or substantially all of the wellbore 114 may be vertical, deviated, horizontal, and/or curved. In an embodiment, the wellbore 114 may be a new hole or an existing hole and may comprise an open hole, cased hole, cemented cased hole, pre-perforated lined hole, or any other suitable configuration, or combinations thereof. For example, in the embodiment of FIG. 1, a casing string 115 is positioned within at least a portion of the wellbore 114 and is secured into position with respect to the wellbore with cement 117 (e.g., a cement sheath). In alternative embodiments, portions and/or substantially all of such a wellbore may be cased and cemented, cased and uncemented, uncased, or combinations thereof. In another alternative embodiment, a casing string may be secured against the formation utilizing one or more suitable packers, such as mechanical packers or swellable packers (for example, SwellPackers™, commercially available from Halliburton Energy Services).

Figure 2:
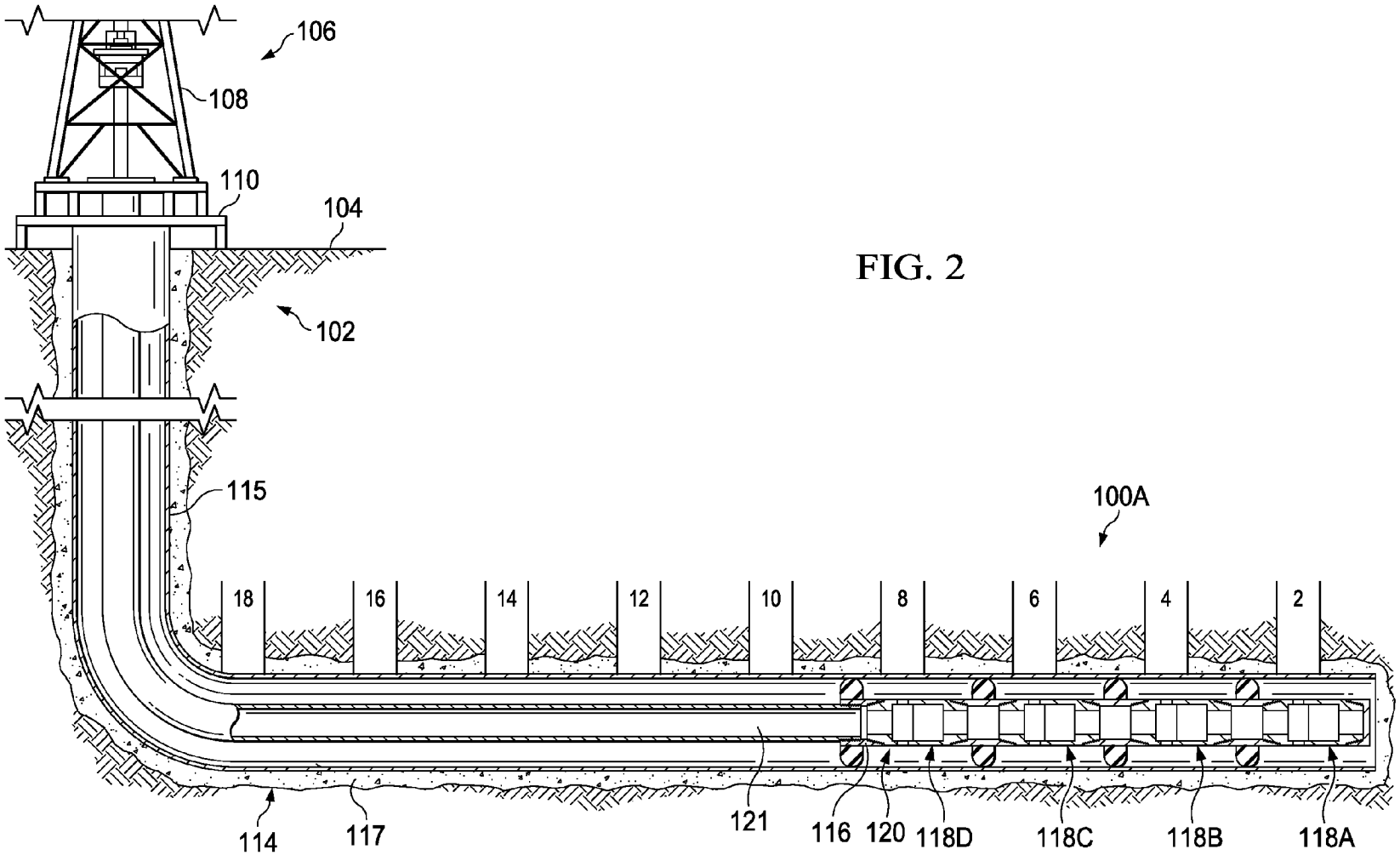
FIG. 2 is a partial cut-away view of an embodiment of a wellbore penetrating a subterranean formation, the wellbore having a wellbore servicing system positioned therein.

Referring to the embodiment of FIG. 2, a first wellbore servicing system 100A is illustrated positioned within the wellbore 114. In additional embodiments, as will be disclosed herein, a second wellbore servicing system, a third wellbore servicing system, a fourth wellbore servicing system, a fifth wellbore servicing system may be positioned within the wellbore 114. In a wellbore servicing system (cumulatively and non-specifically, referred to as a wellbore servicing system 100) generally comprises a plurality of ASAs and a tubular string, for example, the plurality of ASAs being incorporated within the tubular string. For example, in the embodiment of FIG. 2, the first wellbore servicing system 100A generally comprises a first ASA 118A, a second ASA 118B, a third ASA 118C, and a fourth ASA 118D, incorporated within a tubular string 120 defining an axial flowbore 121. Also, in the embodiment of FIG. 2, the first ASA 118A, the second ASA 118B, the third ASA 118C, and the fourth ASA 118D are each positioned proximate and/or substantially adjacent to a first, a second, a third, and a fourth subterranean formation zone, 2, 4, 6, and 8, respectively. Although in the embodiment of FIG. 2, the wellbore servicing system comprises four ASAs, one of skill in the art upon viewing this disclosure will appreciate that a wellbore servicing system like wellbore servicing system 100 may comprise any suitable number of ASAs similarly incorporated within a tubular string such as the tubular string 120, for example one, two, three, four, five, six, seven, eight, or more ASAs. Additionally, while in the embodiment of FIG. 2, a single ASA is located and/or positioned substantially adjacent to each formation zone (e.g., each of zones 2, 4, 6, and 8), in alternative embodiments, two or more ASAs may be positioned proximate and/or substantially adjacent to a given single zone, alternatively, a given single ASA may be positioned adjacent to two or more zones.

In an additional embodiment, the wellbore servicing tool 100 further comprises at least a portion of a connection interface 116. For example, in an embodiment as will be disclosed herein, the wellbore servicing system 100 may be positioned within a wellbore like wellbore 114 suspended from a work string 112 via the connection interface 116. Also, in an embodiment as will be disclosed herein, the first wellbore servicing system may be fluidicly connected to a second wellbore servicing system via the connection interface 116.

In an embodiment, the tubular string 120 may comprise any suitable type and/or configuration of string, for example, as will be appreciated by one of skill in the art upon viewing this disclosure. In an embodiment, the tubular string 120 may comprise one or more tubular members. In an embodiment, each of the tubular members may comprise a suitable means of connection, for example, to other tubular members and/or to the ASAs, as will be disclosed herein. For example, in an embodiment, the terminal ends of the tubular members may comprise one or more internally or externally threaded surfaces, as may be suitably employed in making a threaded connection to other tubular members and/or to the ASAs. In an embodiment, the tubular string 120 may comprise a casing string, a liner, a production string, a completion string, another suitable type of string, or combinations thereof.

Figure 3:
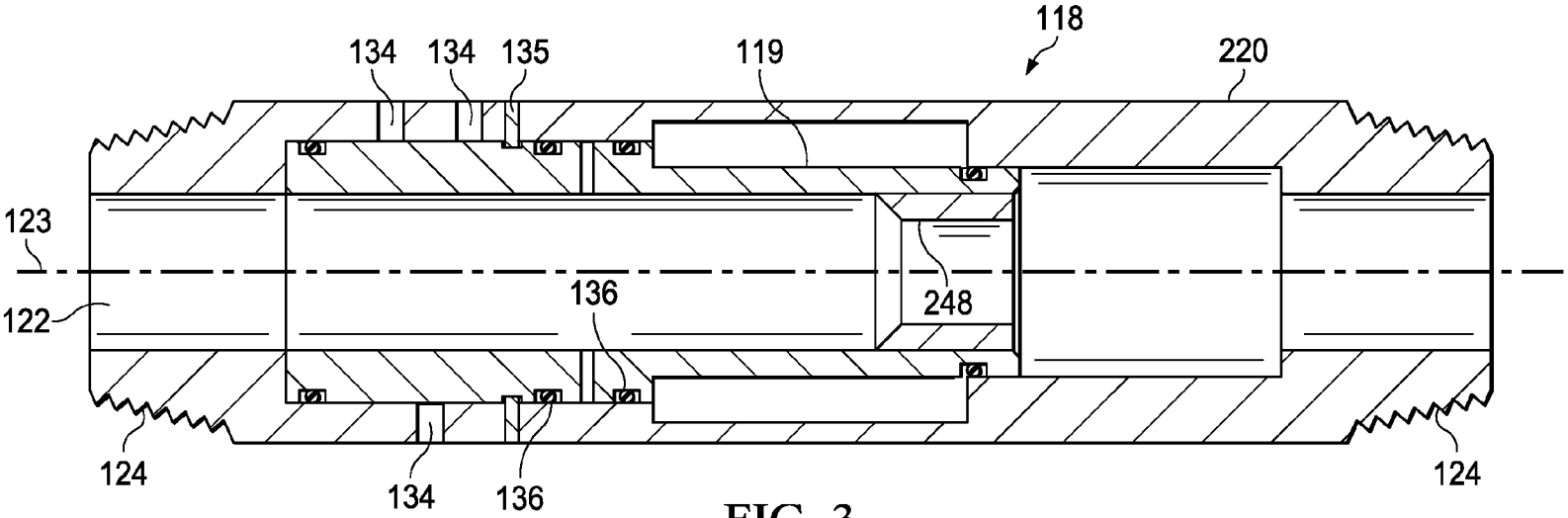
FIG. 3 is a cross-sectional view of an embodiment of an activatable stimulation assembly in a configuration such that a sliding sleeve obscures a route of fluid communication from the axial flowbore to the exterior of the housing via the one or more ports of the activatable stimulation assembly.

Referring to FIG. 3, in an embodiment each of the ASAs (cumulatively and non-specifically referred to as ASA 118) generally comprises a housing 220 and a sliding sleeve 119. As will be disclosed herein, the housing 220 may comprise one or more ports 134 selectively providing a route of fluid communication from an interior (e.g., a flowbore) of the ASA to an exterior of the ASA. As will also be disclosed herein, the sliding sleeve may be selectively movable from a first position relative to the housing, in which the sliding sleeve obstructs the ports (e.g., so as to disallow fluid communication via the ports), to a second position relative to the housing, in which the sliding sleeve does not obstruct the ports (e.g., so as to allow fluid communication via the ports). As will also be disclosed herein, movement of the sliding sleeve may be initiated in an y suitable way.

In an embodiment, the housing 220 may be characterized as a generally tubular body defining an axial flowbore 122 and having a longitudinal axis 123. The axial flowbore 122 may be in fluid communication with the axial flowbore 121 defined by the tubular string 120, for example, such that a fluid may be communicated between the axial flowbore 121 of the tubular string 120 and the axial flowbore 122 of the housing 220.

In an embodiment, the housing 220 may be configured for connection to and or incorporation within a tubular string such as the tubular string 120. For example, the housing 220 may comprise a suitable means of connection to the tubular string 120 (e.g., to a casing string member such as a casing joint or to any other suitable tubular member). For example, in an embodiment, the terminal ends of the housing 220 may comprise one or more internally or externally threaded surfaces, as may be suitably employed in making a threaded connection to the tubular string 120. Alternatively, an ASA may be incorporated within a tubular string (or, alternatively, any other suitable casing string, such as a liner or work string) by any suitable connection, such as, for example, via one or more quick-connector type connections. Suitable connections to a tubular string (e.g., to a tubular member) may be known to those of skill in the art upon viewing this disclosure.

In an embodiment, the housing 220 may comprise a unitary structure; alternatively, the housing 220 may comprise two or more operably connected components (e.g., two or more coupled sub-components, such as by a threaded, welded, or other connection). Alternatively, a housing like housing 220 may comprise any suitable structure; such suitable structures will be appreciated by those of skill in the art with the aid of this disclosure.

In an embodiment, the housing 220 may comprise one or more ports (e.g., ports 134 in the embodiment of FIG. 3) suitable for the communication of fluid from the axial flowbore 122 of the housing 220 to an exterior of the housing 220 (e.g., and to a proximate subterranean formation zone) when the ASA 118 is so-configured (e.g., when the ASA 118 is activated). For example, when the ports 134 within the housing 220 are obstructed or blocked, as will be discussed herein, the ports 134 will not communicate fluid from the axial flowbore 122 to the exterior of the housing 220. Alternatively, when the ports 134 within the housing 220 are unobstructed or unblocked, as will be discussed herein, the ports 134 may communicate fluid from the axial flowbore 122 to the exterior of the housing 220. In an embodiment as will also be disclosed herein, the ports 134 may be fitted with one or more pressure-altering devices (e.g., nozzles, erodible nozzles, fluid jets, or the like). In an additional embodiment, the ports 134 may be fitted with plugs (e.g., foam, polymeric, or ceramic plugs), screens, covers, or shields, for example, to prevent debris from entering the ports 134.

In an embodiment, the sliding sleeve 119 generally comprises a cylindrical or tubular structure. In an embodiment, the sliding sleeve 119 may comprise a single component piece. In an alternative embodiment, a sliding sleeve like the sliding sleeve 119 may comprise two or more operably connected or coupled component pieces (e.g., a collar welded about a tubular sleeve).

In an embodiment, the sliding sleeve 119 may be slidably and concentrically positioned within the housing 220 and movable between a first position and a second position with respect to the housing 220.

In an embodiment, the sliding sleeve 119 may be configured to allow or disallow fluid communication between the axial flowbore 122 of the housing 220 and the exterior of the housing 220, dependent upon the position of the sliding sleeve 119 relative to the housing 220. For example, when the sliding sleeve 119 is in the first position, the sliding sleeve 119 obstructs/blocks the ports 134 of the housing 220 and, thereby, restricts fluid communication via the ports 134.

Alternatively, when the first ASA 118A sliding sleeve 119 is in the second position, the sliding sleeve 119 does not obstruct the ports 134 of the housing 220 and, thereby allows fluid communication via the ports 134. In an additional or alternative embodiment, the sliding sleeve 119 may further comprise one or more ports which may be aligned or misaligned with the ports 134 of the housing 220. In an embodiment, movement of the sliding sleeve 119 from the first position to the second position and/or from the second position to the first position may comprise longitudinal movement of the sliding sleeve 119 with respect to the housing 220, radial movement of the sliding sleeve 119 with respect to the housing 220, or combinations thereof.

In an embodiment, the sliding sleeve 119 may be held in either the first position or the second position by suitable retaining mechanism. For example, in an embodiment, the sliding sleeve 119 may be retained in the first position by a frangible member, such as one or more shear-pins 135. In such an embodiment, the frangible member(s) may be received within a bore and/or bores in each of the housing 220 and the sliding sleeve 119 and may be suitable to retain the sliding sleeve 119 in the first position until a force is applied to the frangible member to cause the frangible member to be sheared, broken, fractured, or the like. Also, in an embodiment, the sliding sleeve 119 may be retained in the second position by a snap-ring, alternatively, by a C-ring, a biased pin, ratchet teeth, or combinations thereof. In such an embodiment, the snap-ring (or the like) may be carried in a suitable slot, groove, channel, bore, or recess in the sliding sleeve 119, alternatively, in the housing 220, and may expand into and be received by a suitable slot groove, channel, bore, or recess in the housing 220, or, alternatively, in the sliding sleeve 119. Such a snap-ring or the like may be suitable to retain the sliding sleeve 119 in the second position after the sliding sleeve has been transitioned to the second position. In an embodiment, such a groove or channel into which a snap-ring or the like may be configured to expand may be tapered, for example, such that, in combination with such snap-ring, the sliding sleeve may be temporarily retained in a desired position, for example, until a sufficient force is applied to the sleeve to move it to another position (e.g., back to the first position).

In an embodiment, the sliding sleeve 119, the housing 220, or both may comprise one or more seals 136 at one or more of the interfaces between the sliding sleeve 119 and the housing 220. In such an embodiment, the sliding sleeve 119 and/or the housing 220 may further comprise one or more radial or concentric recesses or grooves configured to receive one or more suitable fluid seals, for example, to restrict fluid movement via the interface between one or more surfaces of the sliding sleeve 119 and the housing 220. Additionally or alternatively, a seal may be suitably provided at the interface between any two surfaces. Examples of suitable seals include but are not limited to a T-seal, an O-ring, a gasket, or combinations thereof. Additionally, in an embodiment, the seals may contribute to surface friction and, as such, can be used to retain the sliding sleeve in a desired position for a given duration.

In an embodiment, the sliding sleeve may be movable from the first position the second position and/or from the second position to the first position via the operation of any suitable device, apparatus, method, or combinations thereof. For example, in an embodiment the sliding sleeve may be transitionable from the first to the second position or from the second to the first position via the operation of one or more of a mechanical shifting tool, an obturating member (e.g., a ball or dart), a wireline tool, a coiled tubing tool, a pressure differential, a rupture disc, a biasing member (e.g., a spring), or combinations thereof. Suitable sliding sleeves and/or shifting tools and methods of operating the same are disclosed in each of U.S. Publication No. 2011/0088915 to Stanojcic et al. and U.S. Publication No. 2010/0044041 to Smith et al., each of which is incorporated herein in its entirety.

For example, in an embodiment, the sliding sleeve 119 may be configured to be selectively transitioned from the first position to the second position via the operation of an obturating member. For example, in the embodiment of FIG. 3, the sliding sleeve 119 comprises a seat 248 configured to receive, engage, and/or retain an obturating member (e.g., a ball or dart) of a given size and/or configuration moving via axial flowbores 121 and 122. In such an embodiment, the seat 248 comprises a reduced flowbore diameter in comparison to the diameter of axial flowbores 121 and/or 122, such as a bevel at the reduction in flowbore diameter, for example, to engage and retain such an obturating member. In such an embodiment, the seat 248 may be configured such that, when the seat 248 engages and retains such an obturating member, fluid movement via the axial flowbore 122 may be impeded, thereby causing hydraulic pressure to be applied to the sliding sleeve 119 so as to move the sliding sleeve 119 from the first position (e.g., a closed position where the sliding sleeve 119 obstructs the ports 134) to the second position (e.g., an open or activated position where the sliding sleeve 119 does not obstruct the ports 134). As will be appreciated by one of skill in the art viewing this disclosure, a seat, such as seat 248, may be sized and/or otherwise configured to engage and retain an obturating member (e.g., a ball, a dart, or the like) of a given size or configuration. In an embodiment, the seat 248 may be integral with (e.g., joined as a single unitary structure and/or formed as a single piece) and/or connected to the sliding sleeve 119. For example, in embodiment, the expandable seat 248 may be attached to the sliding sleeve 119. In an alternative embodiment, a seat may comprise an independent and/or separate component from the first sliding sleeve but nonetheless capable of applying a pressure to the first sliding sleeve to transition the first sliding sleeve from the first position to the second position. For example, such a seat may loosely rest against and/or adjacent to the first sliding sleeve.

In an alternative embodiment, a sliding sleeve may be transitionable via the operation of a mechanical shifting tool. In such an embodiment, the mechanical shifting tool is suspended from a suitable second work string (for example, which may be positioned within the axial flowbore of the workstring 112). In an embodiment, such a second work string may comprise a coiled tubing string, a wireline, a drill string, a tool string, a segmented tubing string, a jointed tubing string, or any other suitable conveyance, or combinations thereof. In an particular embodiment, a shifting tool may be attached to a coiled tubing (CT) string. In an embodiment, the mechanical shifting tool may be positioned within the wellbore servicing system 100 substantially adjacent to the ASA to be activated and/or deactivated (e.g., the first, second, third, or fourth ASA, 118A, 118B, 118C, or 118D, respectively). The mechanical shifting tool may then be actuated, for example, by introducing an obturating member (e.g., a ball or dart) into the second work string and forward-circulating the obturating member so as to engage a seat or baffle within the mechanical shifting tool. Upon engaging the seat, the obturating member may obstruct the flowbore through the mechanical shifting tool, thereby causing pressure to be applied to the seat to extend one or more extendible members. Extension of the extendible members may cause the extendible members to engage a corresponding or mating structure such as one or more dogs, keys, catches, profiles, grooves, or the like within the sliding sleeve of the proximate ASA (e.g., the ASA to be activated), and thereby engage the sliding sleeve. With the mechanical shifting tool engaged to the sliding sleeve, movement of the second work string (and, thus, the mechanical shifting tool) with respect to the housing 220 may shift the sliding sleeve, thereby obstructing or unobstructing ports 134 of the housing 220 (e.g., windows or doors), thereby either disallowing or allowing fluid communication.

In additional or alternative embodiments, a mechanical shifting tool may be electrically activated (e.g., where the shifting tool is attached to a wireline) or otherwise activated via any suitable process.

In an embodiment, a sliding sleeve may be transitioned from a first position to a second position via flow activation. In such an embodiment, the movement of fluid of a sufficient rate may exert a pressure (e.g., via the friction between the moving fluid and the sleeve) sufficient to shift the sleeve.

In alternative embodiments, an ASA may be activated or deactivated, for example, by transitioning the sliding sleeve from the first position to the second position or, alternatively, from the second position to the first position, by any suitable method or apparatus. Suitable methods and apparatuses which may be used to so activate (e.g., to open ports) and/or deactivate (e.g., to close ports) an ASA may be appreciated by one of skill in the art upon viewing this disclosure.

In an embodiment, the connection interface 116 enables selective attachment and/or detachment of the wellbore servicing system 100 (e.g., to the tubular string 120) to or from another component, such as the work string 112 and/or to another wellbore servicing system. In an embodiment, where the connection interface is engaged, the wellbore servicing system 100 may be locked and/or otherwise connected with the other component (e.g., the work string 112 or to another wellbore servicing system). Alternatively, where the connection interface is disengaged, the wellbore servicing system 100 may be unlocked from and not connected to the other component (e.g., the work string 112 or to another wellbore servicing system).

For example, in an embodiment, the connection interface 116 may generally comprise one or more activatable mating mechanisms configured to selectively engage a corresponding or mating structure such as one or more dogs, keys, catches, profiles, grooves, threads, or any other suitable structures that will be appreciated by those of skill in the art upon viewing this disclosure. For example, in an embodiment the connection interface 116 may comprise a collet assembly, for example, comprising a plurality of collet fingers each having a radially inward or outward protrusion and each being inwardly or outwardly biased. In such an embodiment, the collet fingers may be configured to engage a groove or profile (e.g., a mating structure) when retained with respect to such a groove or profile. Also, in such an embodiment, the collet fingers may be configured to disengage the groove or profile (e.g., the mating structure) when not retained with respect to the groove or profile, for example, when allowed to flex radially inward or outward from the mating structure.

In an embodiment, at least a portion of the connection interface 116 may be integrated within and/or attached to the wellbore servicing system 100 and another portion of the connection assembly may be integrated within and/or attached to another component, such as the work string 112 or another wellbore servicing system (e.g., a second wellbore servicing system). For example, in an embodiment, the mating mechanism(s) may be incorporated within and/or connected to the wellbore servicing system 100 and the corresponding, cooperating, and/or mating structure(s) may be incorporated within and/or connected to the work string 112 or to another wellbore servicing system. Alternatively, in an embodiment, the mating structure(s) may be incorporated within and/or connected to the wellbore servicing system 100 and the corresponding, cooperating, and/or mating mechanism(s) may be incorporated within and/or connected to the work string 112 or to another wellbore servicing system.

In an embodiment, the mating mechanism of the connection interface 116 may be engaged to or disengaged from the mating structure by any suitable method or apparatus. For example, the mating mechanism may be hydraulically, mechanically, electronically, electrically, or otherwise disengaged from and/or engaged with the mating structure. For example, in an embodiment, the mating mechanism may be engaged to or disengaged from the mating structure via the operation of a mechanical shifting (e.g., as disclosed herein), a wireline tool, an obturating member (e.g., a ball or dart), a hydraulic and/or electric actuator, or combinations thereof.

One or more embodiments of an ASA 118 and a wellbore servicing system 100 comprising one or more ASAs like ASA 118 (e.g., ASAs 118A-118D) having been disclosed, one or more embodiments of a wellbore servicing method employing such a wellbore servicing system 100 and/or such an ASA 118 are also disclosed herein. In an embodiment, a wellbore servicing method may generally comprise the steps of disposing at least a portion of a wellbore servicing system (e.g., a first wellbore servicing system) within an wellbore penetrating the subterranean formation, providing a route of fluid communication via the first ASA, communicating a treatment fluid via the first ASA, and embedding a first portion of the wellbore servicing system within the wellbore. Additionally, in an embodiment a wellbore servicing method may further comprise repeating the sequence of providing a route of fluid communication via a given ASA, communicating treatment fluid via that particular ASA, and embedding an additional portion of the wellbore servicing system for each of the ASAs comprising (e.g., incorporated within) the first wellbore servicing system.

In an additional embodiment, a wellbore servicing method may further comprise disconnecting the wellbore servicing system from the work string. Additionally, in an embodiment, a wellbore servicing method may still further comprise disposing a second wellbore servicing system within the wellbore, and repeating the sequence of providing a route of fluid communication via a given ASA, communicating treatment fluid via that particular ASA, and embedding an additional portion of the wellbore servicing system for each of the ASAs incorporated within the second wellbore servicing system.

Figure 4A:
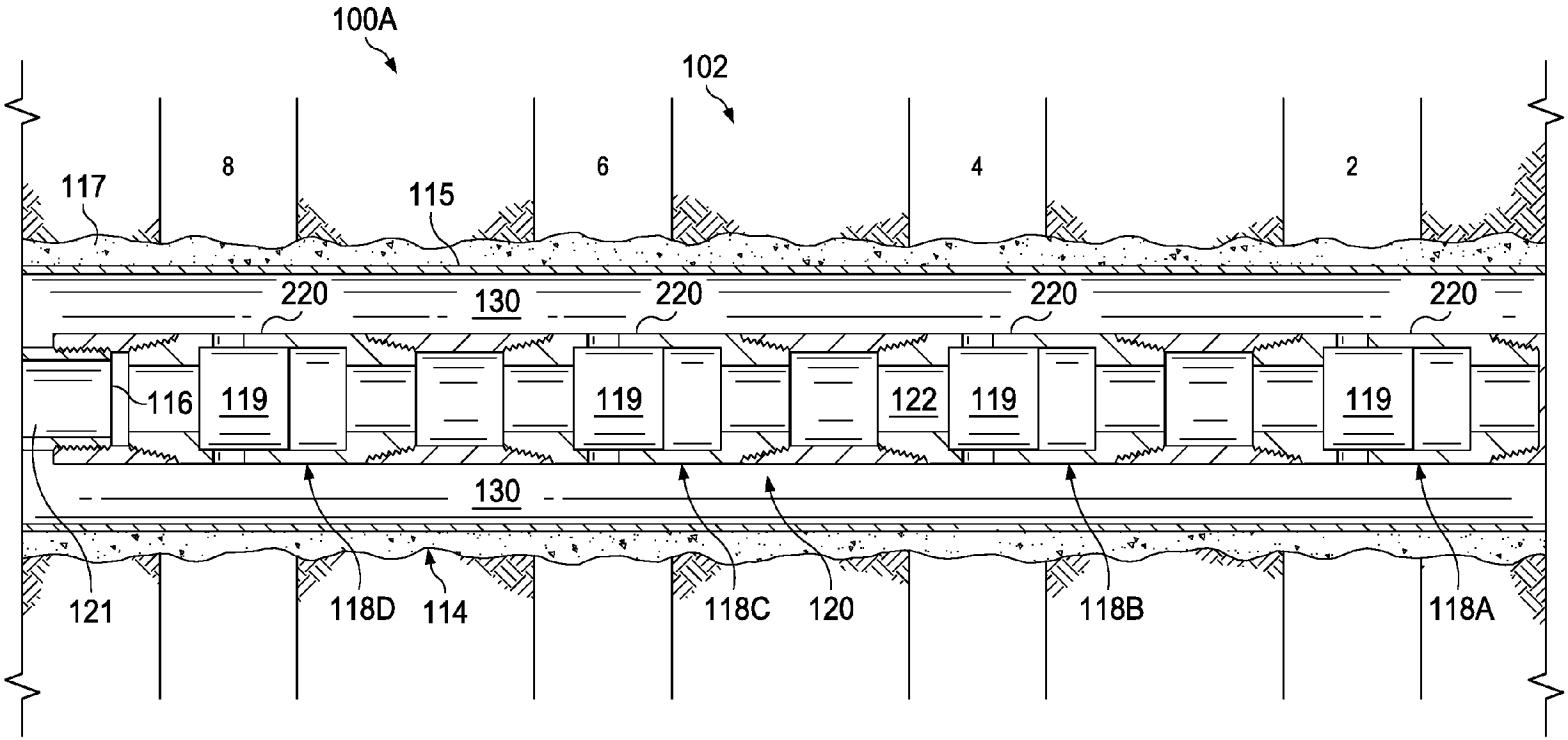
FIG. 4A is a cut-away view of an embodiment of the wellbore servicing system of FIG. 2, the wellbore servicing system having a plurality of activatable stimulation assemblies which may be selectively configured to provide a route of fluid communication to the subterranean formation.

In an embodiment, a wellbore servicing system (e.g., the first wellbore servicing system 100A) comprising one or more ASAs incorporated within a tubular string, like tubular string 120, may be positioned within a wellbore like wellbore 114. For example, in the embodiment of FIG. 2, the first wellbore servicing system 100A comprises a tubular string 120 having incorporated therein the first ASA 118A, the second ASA 118B, the third ASA 118C, and the fourth ASA 118D. Also in the embodiment of FIG. 2, the tubular string 120 is positioned within the wellbore 114 such that the first ASA 118A is proximate and/or substantially adjacent to the first subterranean formation zone 2, the second ASA 118B is proximate and/or substantially adjacent to the second zone 4, the third ASA 118C is proximate and/or substantially adjacent to the third zone 6, the fourth ASA 118D is proximate and/or substantially adjacent to the fourth zone 8. Alternatively, any suitable number of ASAs may be incorporated within a tubular string. Referring to FIG. 4A, in an embodiment, the ASAs (e.g., ASAs 118A-118D) may be positioned within the wellbore 114 in a configuration in which no ASA (e.g., none of ASAs 118A-118D) incorporated within the wellbore servicing system 100 will communicate fluid to the subterranean formation, that is, all ASAs are deactivated. Particularly, the ASAs may be positioned within the wellbore 114 in the first, run-in, or installation mode or configuration, for example, such that the sliding sleeve is retained in its first position and such that the ASA will not communicate a fluid via its ports 134, as disclosed herein with regard to ASA 118.

In an embodiment, and as will be disclosed herein, the wellbore servicing system may be positioned within the wellbore 114 such that an annular space 130 extending circumferentially around the wellbore servicing system 100 between the wellbore servicing system 100 and the casing 115 (alternatively, in an embodiment where the wellbore is uncased, between the wellbore servicing system 100 and the wellbore walls) remains open and/or substantially unobstructed. For example, as will be disclosed herein, the annular space 130 may be capable of allowing fluid communication therethrough.

In an embodiment, the zones of the subterranean formation (e.g., 2, 4, 6, and/or 8) being adjacent or proximate to an ASA (e.g., one of the first, second third, or fourth ASAs 118A, 118B, 118C, or 118D, respectively) of the wellbore may be serviced working from the zone that is furthest down-hole or "toe" (e.g., in the embodiment of FIG. 2, the first formation zone 2) progressively upward toward the furthest up-hole zone or "heel" (e.g., in the embodiment of FIG. 1, the fourth formation zone 8). In alternative embodiments, the zones of the subterranean formation may be serviced in any suitable order. As will be appreciated by one of skill in the art, upon viewing this disclosure, the order in which the zones are serviced may be dependent upon, or at least influenced by, the method of activation chosen for each of the ASAs associated with each of these zones.

In an embodiment where the subterranean formation is serviced working from the furthest down-hole subterranean formation zone progressively upward, once the wellbore servicing system (e.g., the first wellbore servicing system 100A, comprising the plurality of ASAs incorporated within the tubular string) has been positioned within the wellbore, a route of fluid communication to the subterranean formation (e.g., to a first zone 2 of the subterranean formation) may be provided via the first ASA 118A. In an embodiment, the step of providing a route of fluid communication via the first ASA 118A may comprise transitioning the sliding sleeve 119 within the first ASA 118A from its first position to its second position, thereby activating the first ASA.

For example in an embodiment where the first ASA 118A is configured for activation via the operation of an obtuarating member, transitioning the sliding sleeve 119 within the first ASA 118A to its second position may comprise introducing an obtuarting member (e.g., a ball or dart) configured to engage a seat or baffle within that ASA 118 (e.g., ASA 118A) into the work string 112 and communicating the obturating member via the work string 112 and/or tubular string 120 so as to engage the seat or baffle within the first ASA 118A. In an embodiment, upon engagement of the obturating member, continued application of fluid pressure (e.g., by pumping), thereby exerting a hydraulic pressure against the sliding sleeve 119, may cause the sliding sleeve 119 to transition from a first position to a second position. In an embodiment, the obturating member may communicated via the axial flowbore of one or more other ASAs (e.g., ASAs 118B-118D) en route to the intended ASA (e.g., ASA 118A) without engaging a seat or baffle in any one or more of such other ASAs (e.g., the second, third, and fourth ASAs 118B, 118C, and 118D, respectively). For example, in an embodiment where one or more of the ASAs of a wellbore servicing system are configured for activation via the operation of an obturating member, progressively more uphole ASAs may be configured to engage progressively larger obturating members, for example, such that a smaller obturating member will pass therethrough.

Alternatively, in an embodiment where the first ASA 118A is configured for activation via the operation of a mechanical shifting tool, transitioning the sliding sleeve 119 within the first ASA 118A to its second position may comprise positioning a mechanical shifting tool, for example, as disclosed herein, adjacent and/or substantially proximate to the ASA to be activated, and actuating the mechanical shifting tool such that the mechanical shifting tool engages (e.g., becomes fixed or attached to) the sliding sleeve of the ASA to be activated (e.g., the first ASA 118A). Upon engagement of the sliding sleeve by the mechanical shifting tool, as disclosed herein, movement of the mechanical shifting tool relative to the ASA will move the sliding sleeve of that ASA, thereby allowing the sliding sleeve to be transitioned from the first position to the second position or, alternatively, from the second position to the first position.

In an embodiment, (e.g., independent of the means by which the sliding sleeve of a given ASA is transitioned from the first position to the second position) as the sliding sleeve 119 moves from the first position to the second position, the sliding sleeve 119 ceases to obstruct or block the ports 134 within the housing 220, thereby opening the ports and providing a route of fluid communication via the first ASA 118A to the proximate and/or substantially adjacent zone of the subterranean formation (e.g., the first formation zone 2, in the embodiment of FIGS. 2 and 4A-4F).

In an embodiment, when the first ASA 118A is configured for the communication of a servicing fluid, for example, when the sliding sleeve of the first ASA 118A has transitioned to the second position, as disclosed herein, and the ASA is activated, a suitable wellbore servicing fluid (or a portion thereof) may be communicated to the first subterranean formation zone 2 via the unobscured ports 134 of the first ASA 118A. Non-limiting examples of a suitable wellbore servicing fluid include but are not limited to a fracturing fluid, a perforating or hydrajetting fluid, an acidizing fluid, the like, or combinations thereof. The wellbore servicing fluid may be communicated at a suitable rate and pressure for a suitable duration. For example, as will be disclosed herein, the wellbore servicing fluid may be communicated at a rate and/or pressure sufficient to initiate or extend a fluid pathway (e.g., a perforation or fracture) within the subterranean formation 102 and/or a zone thereof.

In an embodiment, communicating a treatment fluid via the first ASA 118A (e.g., which has previously been configured to provide a route of fluid communication via the ports thereof), may comprise communicating a perforating (e.g., a hydrajetting) fluid. In such an embodiment, the perforating fluid may comprise an abrasive fluid (e.g., sand) and may be pumped at an effective rate and/or pressure sufficient to abrade the subterranean formation 102. Additionally, in an embodiment where a casing string and/or cement sheath surrounding the casing string are present, the perforating fluid may abrade the casing string, the cement sheath, the formation (e.g., so as to initiate a fracture within the formation), or combinations thereof. For example, referring to FIG. 4B, in an embodiment such a perforating fluid may be communicated into the wellbore 114 via a flowpath comprising the flowbores of the work string 112, the tubular string 220, and the ASAs (ASAs 118B, 118C, and 118D), and the exposed ports of the first ASA 118A (e.g., a second flowpath, demonstrated by flow arrow B in FIG. 4B) while fluid within an annular space 130 (e.g., a first flowpath, demonstrated by flow arrow A) may or may not be held static or substantially static.

In an embodiment, and as disclosed herein, the ports 134 may be fitted with one or more pressure-altering devices, particularly, the ports 134 may be fitted with erodible nozzles, or the like. In such an embodiment, as the perforating fluid is communicated via the ports 134 fitted with the erodible nozzles, the erodible nozzles are eroded (e.g., degraded) such that the cross-sectional flow-area of the ports 134 increases, for example, thereby allowing for the communication of an increased volume of fluid.

In an embodiment, communicating a treatment fluid via the first ASA may further comprise communicating a fracturing fluid. In an embodiment, such a fracturing fluid may comprise a composite fluid. As used herein, the term "composite fluid" generally refers to a treatment fluid comprising at least two component fluids which are communicated into the wellbore separately and mixed therein. In such an embodiment, the two or more component fluids may be delivered into the wellbore separately, for example, via a first and second flow paths, as disclosed herein, and substantially intermingled or mixed within the wellbore (e.g., in situ) so as to form the composite treatment fluid. Composite treatment fluids are disclosed in U.S. Publication No. 2010/0044041 to Smith et al., U.S. Pat. No. 5,765,642 to Surjaatmadja, U.S. Pat. No. 6,662,874 to Surjaatmadja et al., U.S. Pat. No. 6,719,054 to Cheng et al., U.S. Pat. No. 6,725,933 to Middaugh et al., and U.S. Pat. No. 6,779,607 to Middaugh et al., each of which is incorporated herein in its entirety. In such an embodiment, the composite fluid may be formed within the wellbore, for example, within a portion of the wellbore proximate to the first stimulation site (e.g., proximate to the formation zone 2 in FIG. 4B).

In an embodiment, each of the two separate flow paths into the wellbore may comprise any suitable flow path. Examples of multiple flow paths into a wellbore and methods of utilizing multiple flow paths are disclosed in U.S. Publication No. 2010/0044041 to Smith et al. U.S. Pat. No. 5,765,642 to Surjaatmadja, U.S. Pat. No. 6,662,874 to Surjaatmadja et al., U.S. Pat. No. 6,719,054 to Cheng et al., U.S. Pat. No. 6,725,933 to Middaugh et al., and U.S. Pat. No. 6,779,607 to Middaugh et al., each of which is incorporated herein in its entirety.

In an embodiment, the composite treatment fluid may comprise a fracturing fluid (e.g., a composite fracturing fluid). In such an embodiment, the fracturing fluid may be formed from a first component fluid and a second component fluid. For example, in such an embodiment, the first component fluid may comprise a proppant-laden slurry (e.g., a concentrated proppant-laden slurry) and the second component may comprise a fluid with which the proppant-laden slurry may be mixed to yield the composite fracturing fluid, that is, a diluent (e.g., an aqueous fluid, such as water or a brine).

In an embodiment, the proppant-laden slurry (e.g., the first component) generally comprises a base fluid and a proppant. In an embodiment, the base fluid may comprise a substantially aqueous fluid. As used herein, the term "substantially aqueous fluid" may refer to a fluid comprising less than about 25% by weight of a non-aqueous component, alternatively, less than 20% by weight, alternatively, less than 15% by weight, alternatively, less than 10% by weight, alternatively, less than 5% by weight, alternatively, less than 2.5% by weight, alternatively, less than 1.0% by weight of a non-aqueous component. Examples of suitable substantially aqueous fluids include, but are not limited to, water that is potable or non-potable, untreated water, partially treated water, treated water, produced water, city water, well-water, surface water, or combinations thereof. In an alternative or additional embodiment, the base fluid may comprise an aqueous gel, a viscoelastic surfactant gel, an oil gel, a foamed gel, an emulsion, an inverse emulsion, or combinations thereof.

In an embodiment, the proppant may comprise any suitable particulate material. Examples of suitable proppants include, but are not limited to, graded sand, resin coated sand, bauxite, ceramic materials, glass materials, walnut hulls, polymeric materials, resinous materials, rubber materials, and the like. In an embodiment, the proppant may comprise at least one high density plastic. As used herein, the term "high density plastic" refers to a plastic having a specific gravity of greater than about 1. For example, the density range may be from about 1 to about 2, alternatively, from about 1 to about 1.3, alternatively, from about 1.1 to 1.2. In an embodiment, the proppants may be of any suitable size and/or shape. For example, in an embodiment the proppants may have a size in the range of from about 2 to about 400 mesh, U.S. Sieve Series, alternatively, from about 8 to about 120 mesh, U.S. Sieve Series.

In an embodiment, the diluent (e.g., the second component) may comprise a suitable aqueous fluid, aqueous gel, viscoelastic surfactant gel, oil gel, a foamed gel, emulsion, inverse emulsion, an acid, liquid carbon dioxide ($CO_2$), nitrogen, or combinations thereof. For example, the diluent may comprise one or more of the compositions disclosed above with reference to the base fluid. In an embodiment, the diluent may have a composition substantially similar to that of the base fluid, alternatively, the diluent may have a composition different from that of the base fluid.

In an alternative embodiment, any suitable alternative treatment fluid may comprise a composite fluid, similar to the composite fracturing fluid disclosed herein. Example of suitable alternative treatment fluids include, but are not limited to, an acidizing fluid, a liquefied hydrocarbon gas, and/or a reactive fluid.

Figure 4B:
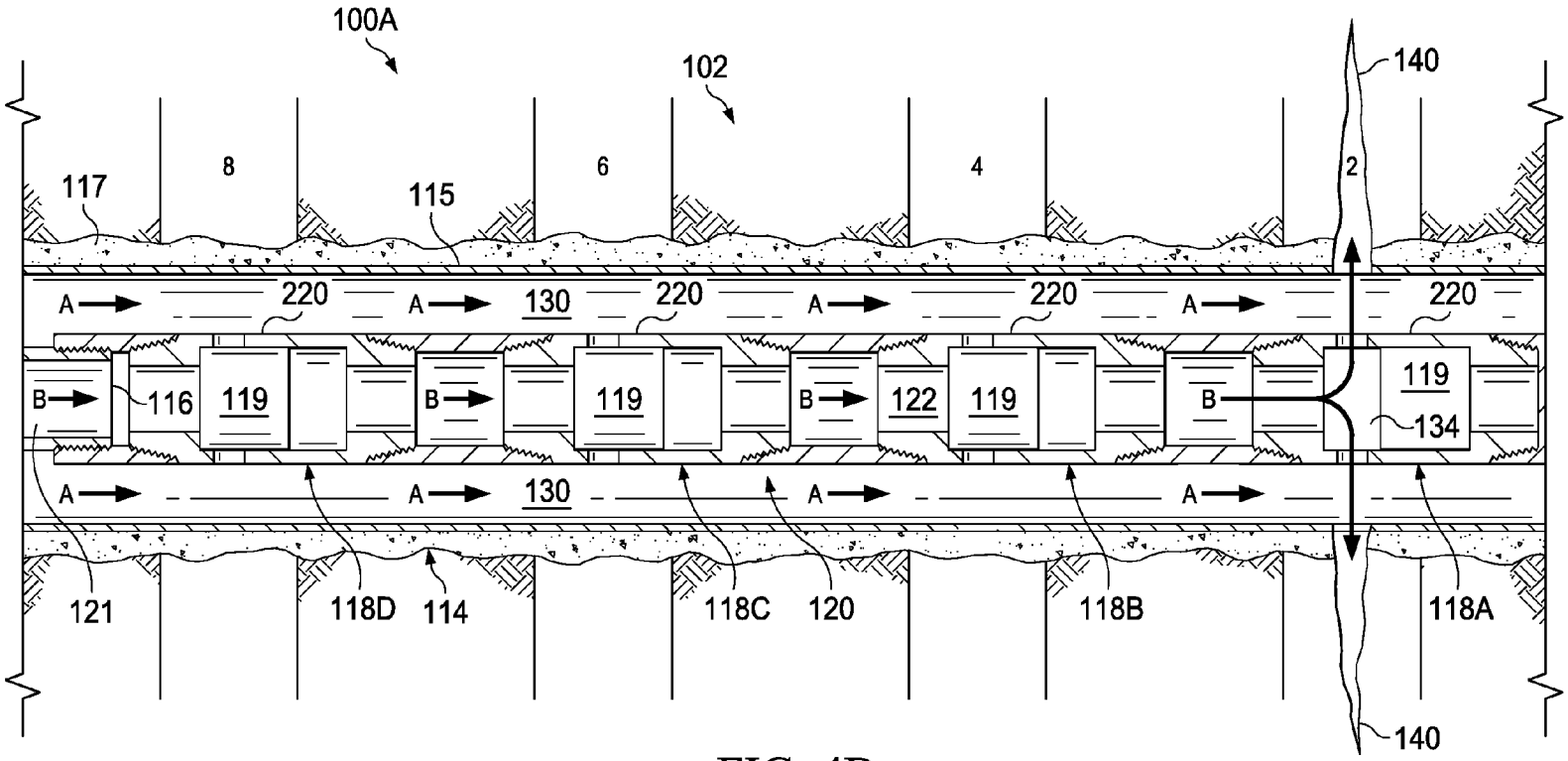
FIG. 4B is a cut-away view of an embodiment of the wellbore servicing system of FIG. 2, a wellbore servicing fluid being communicated to the subterranean formation via a first of the activatable stimulation assemblies.

In an embodiment where the fracturing fluid comprises a composite fluid, a first component of the composite treatment fluid may be introduced into the wellbore via one of the first or second flow paths and a second component of the composite treatment fluid may be introduced into the wellbore via the other of the first or second flow paths. As used herein, a first flow path may refer to any one or more of the disclosed first flow paths, unless otherwise noted, and a second flow path may refer to any one or more of the disclosed second flow paths, unless otherwise noted. In an embodiment, the first and/or second components of the composite treatment may be introduced at relative rates so as to form a composite treatment fluid having a desired composition or character. In the embodiment of FIG. 4B (e.g., where the composite treatment fluid comprises a fracturing fluid), the diluent (e.g., an aqueous or substantially aqueous fluid) may be introduced into the wellbore via the first flow path, as demonstrated by flow arrows A (e.g., via an annular spacing 130 generally defined by the tubular string 120 and the casing string 115 or, where uncased, by the tubular string 120 and the walls of the wellbore 114), and the proppant-laden fluid (e.g., a concentrated, proppant-laden fluid) may be introduced into the wellbore via the second flow path, as demonstrated by flow arrows B (e.g., the flowbore of the wellbore servicing system and the port(s) 134 of the first ASA 118). In an alternative embodiment, the diluent may be introduced into the wellbore via the second flow path, as demonstrated by flow arrow B, and the proppant-laden fluid may be introduced into the wellbore via the first flow path, as demonstrated by flow arrow A.

In an embodiment, the first component of the composite treatment fluid may be introduced at a rate and/or pressure independent of the rate and/or pressure at which the second component of the composite treatment fluid is introduced. For example, in an embodiment, the relative quantities of the first component and the second component, which may combine to form the composite treatment fluid, may be varied. In such an embodiment, the composition and/or character of the resulting composite treatment fluid (e.g., a fracturing fluid) may be altered by altering the relative rates at which the first and second components are provided (e.g., pumped) into the wellbore, as will be disclosed herein.

In an embodiment, the first and second components may cumulatively be provided at a rate such that the composite treatment fluid (e.g., a fracturing fluid) may initiate and/or extend a fracture 140 within the formation (e.g., within the first formation zone 2). For example, in an embodiment, the additive rate at which the first and second components of the treatment fluid are provided may equal or exceed the rate at which the composite fluid is placed into the formation 102. Additionally, in an embodiment, the additive rate at which the first and second components of the treatment fluid are provided may be sufficient to result in an increase in the pressure of the composite treatment fluid within the wellbore, for example, so as to meet or exceed a fracture initiation pressure or a fracture extension pressure in at least one of formation zones 2, 4, 6, or 8. As used herein, the term "fracture initiation pressure" may refer to the hydraulic pressure which may cause a fracture to form within a portion of a subterranean formation and the term "fracture extension pressure" may refer to the amount of hydraulic pressure which will cause a fracture within a formation to be further extended within that formation.

In an embodiment, the composition and/or character of the composite treatment fluid may be varied or altered over the course of the treatment operation. For example, in an embodiment, as the composite treatment fluid is initially introduced into the formation, for example, to initiate a fracture within one or more formation zones, the composite treatment fluid may comprise a relatively lesser amount of proppant or particulate material, alternatively, substantially no proppant or particulate material (e.g., a "pad" fluid). Also, in an embodiment, as a given fracture is extended with a formation zone, the relative amount of proppant within the composite treatment fluid may be increased. As noted above, the concentration of proppant within the composite fracturing fluid may be varied by changing the relative rates at which the first and second components thereof are provided into the wellbore for forming the composite fluid.

In an embodiment, when the formation zone has been stimulated to a desired extent (for example, when one or more fractures have been extended into the formation to a desired distance from the wellbore), at least a portion of the wellbore servicing system 100 may be embedded within the wellbore 114. As used herein, the term "embedding" may refer to a process by which at least a portion of a wellbore servicing system, like wellbore servicing system 100, becomes substantially secured within the wellbore via placement of a particulate material (e.g., proppant) and/or by which flow an annular flowpath surrounding the wellbore servicing system becomes at least substantially obstructed (e.g., such that flow via the annular spaced is inhibited and/or prohibited).

Figure 4C:
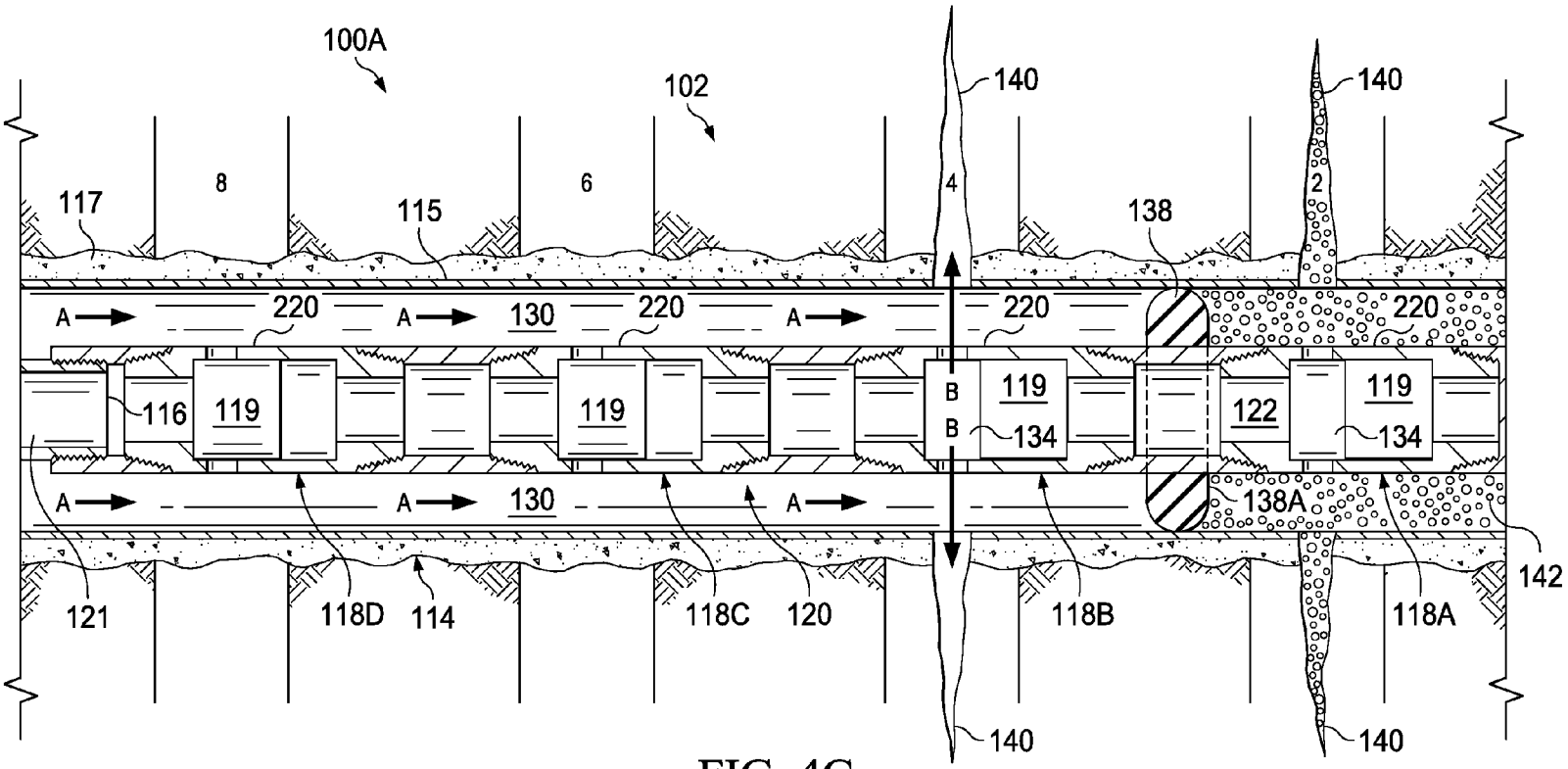
FIG. 4C is a cut-away view of an embodiment of the wellbore servicing system of FIG. 2, a wellbore servicing fluid being communicated to the subterranean formation via a second of the activatable stimulation assemblies, and a first portion of the wellbore servicing system being embedded within the wellbore.

In an embodiment, embedding a first portion of the wellbore servicing system within the wellbore may comprise causing a particulate material to substantially fill and become disposed within at least a portion of the annular space. For example, when disposed within the annular space (or a portion thereof), the particulate material may form a pack, for example, a static state in which the individualized particles are in contact with each other, for example, having a frictional relationship impeding relative movement. Also, such a pack may form a barrier to fluid movement, for example, such that fluid is inhibited from movement and/or will move through the interstitial spaces within particulate pack at a relatively reduced rate. For example, as noted above, an operator may alter the character of a composite fluid produced within the wellbore by altering the rate at which either the first component and/or the second component of a composite fluid is pumped (e.g., the relative rates of the first and second components). Referring to FIG. 4C, in an embodiment, by altering the character of the composite fluid formed within the wellbore 114, the operator may induce the formation of a "screen-out" such that further fracturing fluid ceases to enter the formation (e.g., the first formation zone 2). Particularly, in an embodiment, the operator may induce such a screen-out by increasing the relative proportion of the concentrated, particle-laden (e.g., proppant-laden) fluid within the composite fluid. In an embodiment, continuing to pump relatively high proportions of the concentrated, particle-laden fluid may cause at least a portion of the annular space 130 (e.g., a portion of the annular space substantially proximate and/or adjacent to the ports of the first ASA 118A) to become filled or substantially filled with particulate material (e.g., proppant and/or sand). In an embodiment, the particulate material may fill and/or become deposited within the portion of the annular space 130 such that the wellbore servicing tool 100 becomes secured (e.g., packed) into place within the wellbore. For example, such a quantity of particulate material may form a pack within the annular space 130 surrounding the wellbore servicing tool 100 such that the wellbore servicing tool becomes stuck into place with respect wellbore and, as such, is inhibited from movement within the wellbore (e.g., upward or downward movement. Also, in an embodiment, the particulate material may fill and/or become deposited within the portion of the annular space 130 such that fluid movement through that portion of the annular space 130 is substantially inhibited and/or prohibited. As such, a portion of the annular space 130 becomes filled with particulate material, at least a portion of the wellbore servicing system 100 (e.g., a portion of the wellbore servicing system 100 substantially proximate and/or adjacent to the ports of the first ASA 118A) may become embedded (e.g., by the particulate material surrounding the wellbore servicing system) within the wellbore 114, for example, as illustrated in FIG. 4C.

In an additional embodiment, embedding a first portion of the wellbore servicing system within the wellbore may further comprise deploying one or more packers (e.g., mechanical packers or swellable packers, such as SwellPackers™, commercially available from Halliburton Energy Services). For example, in the embodiment of FIG. 4C, a first packer 138A (located downhole relative to the second ASA 118B) may be deployed, for example, to further secure the wellbore servicing system 100 within the wellbore 114 and/or to inhibit fluid communication between zones (e.g., between the first zone 2 and the second, third, and fourth zones, 4, 6, and 8, respectively, or any other relatively uphole zones).

In an embodiment, the process of providing a route of fluid communication via a given ASA, communicating treatment fluid via that particular ASA, and embedding an additional portion of the wellbore servicing system may be repeated for each of the ASAs incorporated within the first wellbore servicing system. For example, in an embodiment, the process of transitioning a sliding sleeve within an ASA from its first position to its second position so as to provide a route of fluid communication to the subterranean formation via that ASA, communicating a servicing fluid to the zone via that ASA, and embedding a portion (e.g., an addition portion) of the first wellbore servicing system 100A may be repeated with respect to each of the second, third, and fourth ASAs, 118B, 118C, and 118D, respectively, and the formation zones 4, 6, and 8, associated therewith.

Figure 4D:
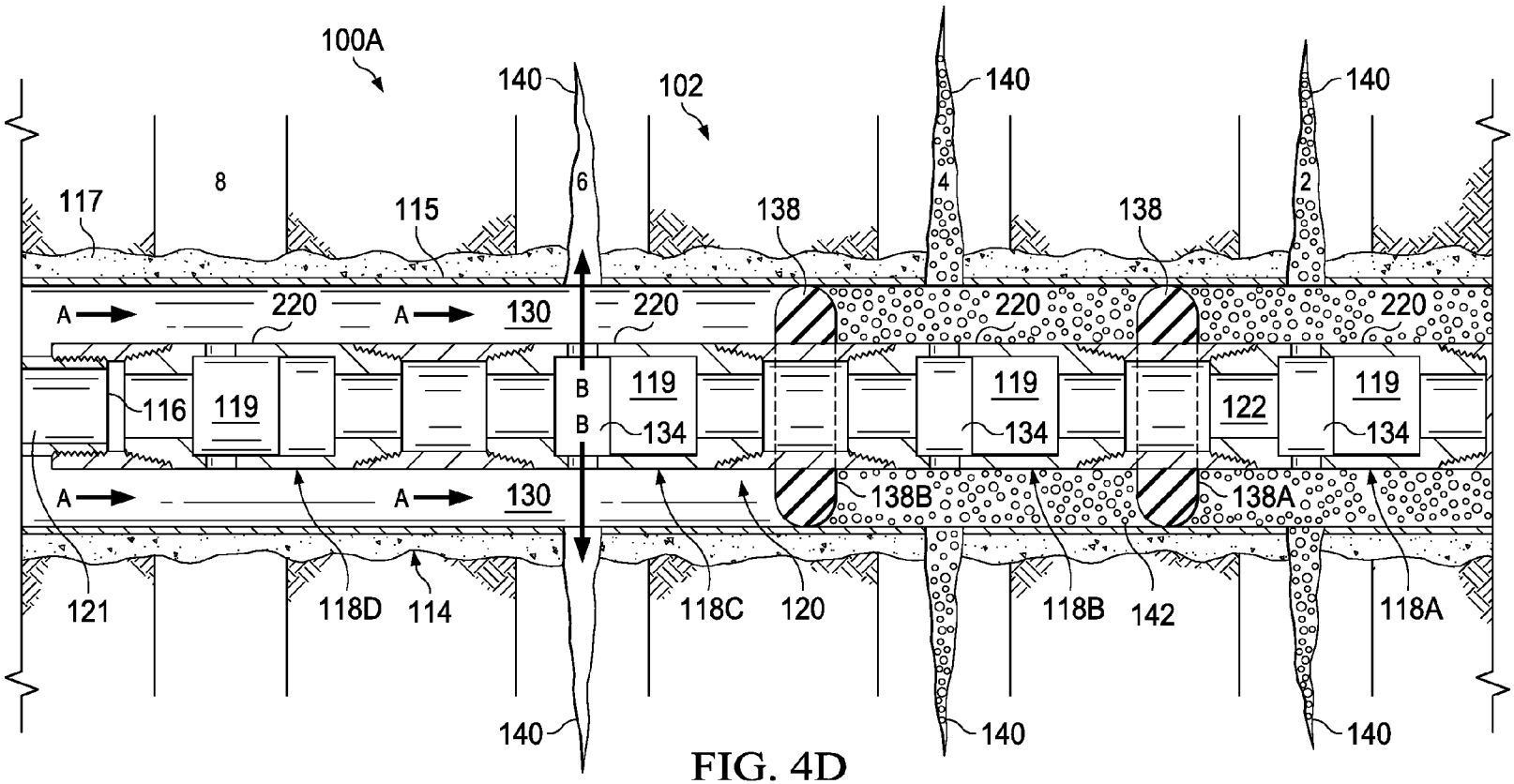
FIG. 4D is a cut-away view of an embodiment of the wellbore servicing system of FIG. 2, a wellbore servicing fluid being communicated to the subterranean formation via a third of the activatable stimulation assemblies, and a first and second portions of the wellbore servicing system being embedded within the wellbore.

For example, referring to FIGS. 4C and 4D, after the first formation zone 2 has been treated and a first portion of the first wellbore servicing system (e.g., a portion proximate to the first ASA 118A) has been embedded, the second formation zone 4 may be treated, for example, via the second ASA 118B, in a manner similar to that disclosed herein with respect to the first zone and/or the first ASA 118A, and a second portion of the wellbore servicing system may be embedded and, optionally, isolated via a second packer 138B.

Figure 4E:
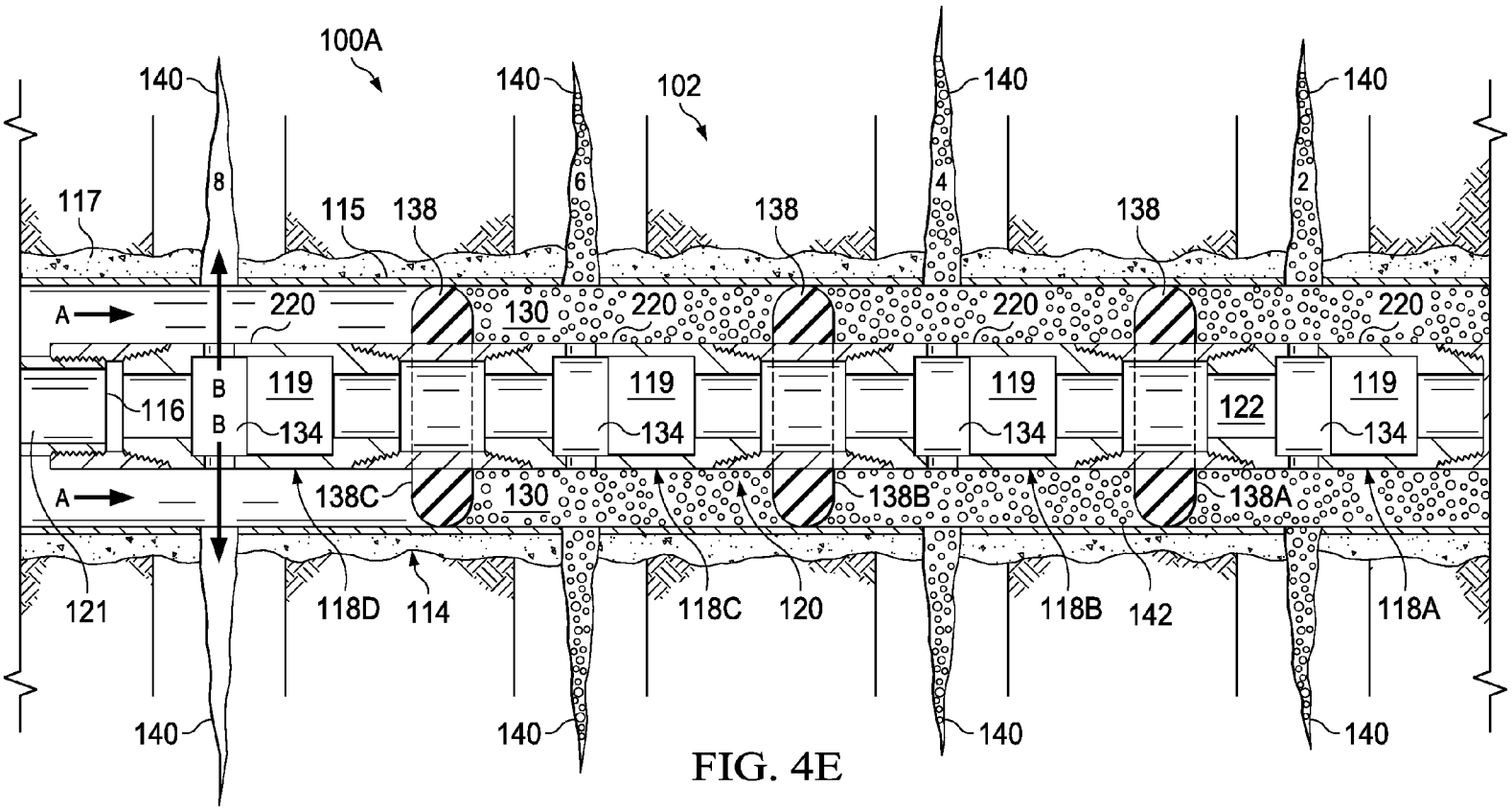
FIG. 4E is a cut-away view of an embodiment of the wellbore servicing system of FIG. 2, a wellbore servicing fluid being communicated to the subterranean formation via a fourth of the activatable stimulation assemblies, and a first, second, and third portions of the wellbore servicing system being embedded within the wellbore.

Similarly, referring to FIGS. 4D and 4E, after the second formation zone 4 has been treated and a second portion of the first wellbore servicing system (e.g., a second portion proximate to the second ASA 118B) has been embedded, the third formation zone 6 may be treated, for example, via the third ASA 118C, in a manner similar to that disclosed herein with respect to the first zone and/or the first ASA 118A, and a third portion of the wellbore servicing system may be embedded and, optionally, isolated via a third packer 138C.

Figure 4F:
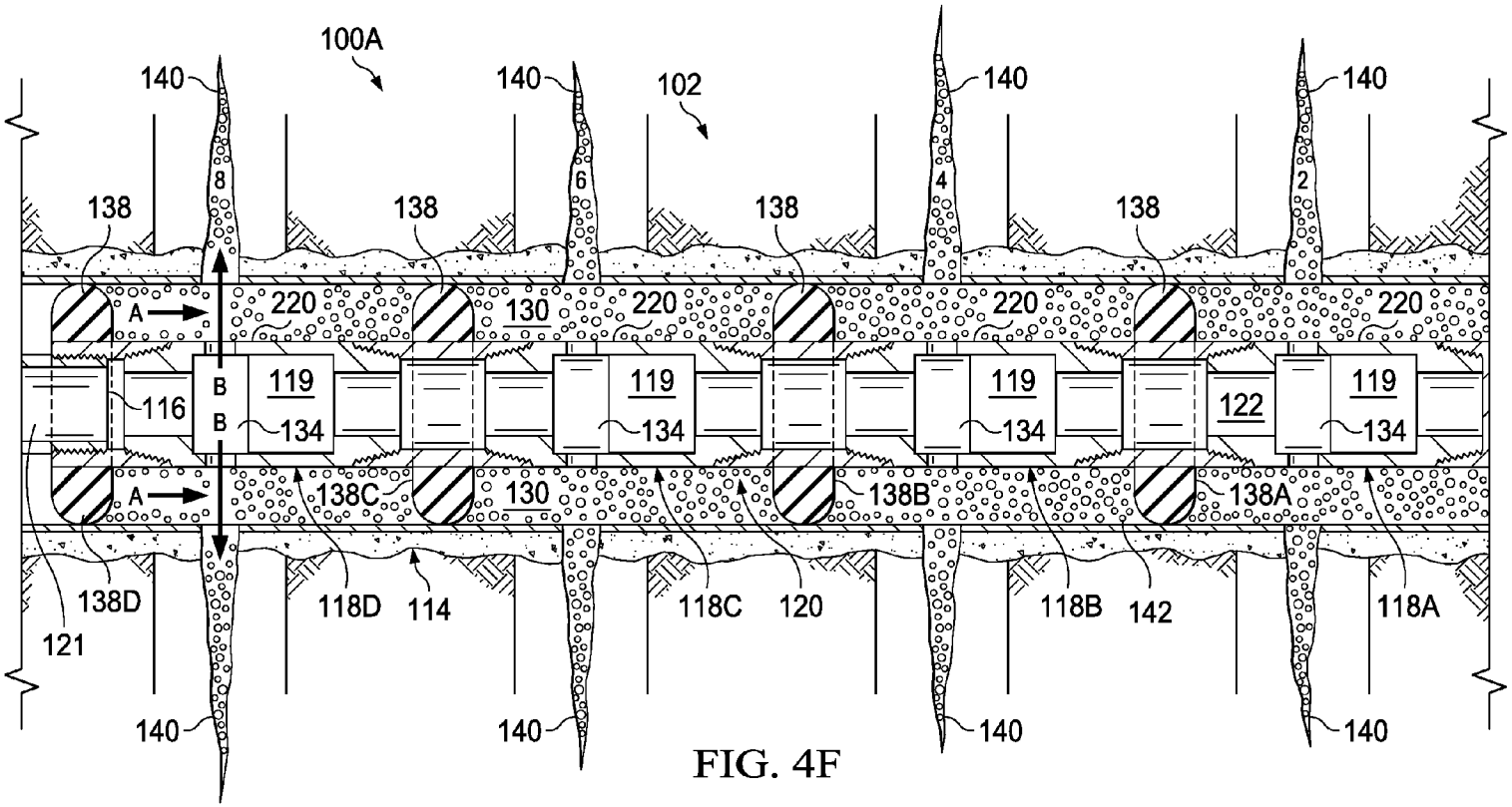
FIG. 4F is a cut-away view of an embodiment of the wellbore servicing system of FIG. 2, the wellbore servicing system being substantially embedded within the wellbore.

Similarly, referring to FIGS. 4E and 4F, after the third formation zone 6 has been treated and a third portion of the first wellbore servicing system (e.g., a third portion proximate to the third ASA 118C) has been embedded, the fourth formation zone 8 may be treated, for example, via the fourth ASA 118D, in a manner similar to that disclosed herein with respect to the first zone and/or the first ASA 118A, and a fourth portion of the wellbore servicing system may be embedded and, optionally, isolated via a fourth packer 138D.

Figure 5:
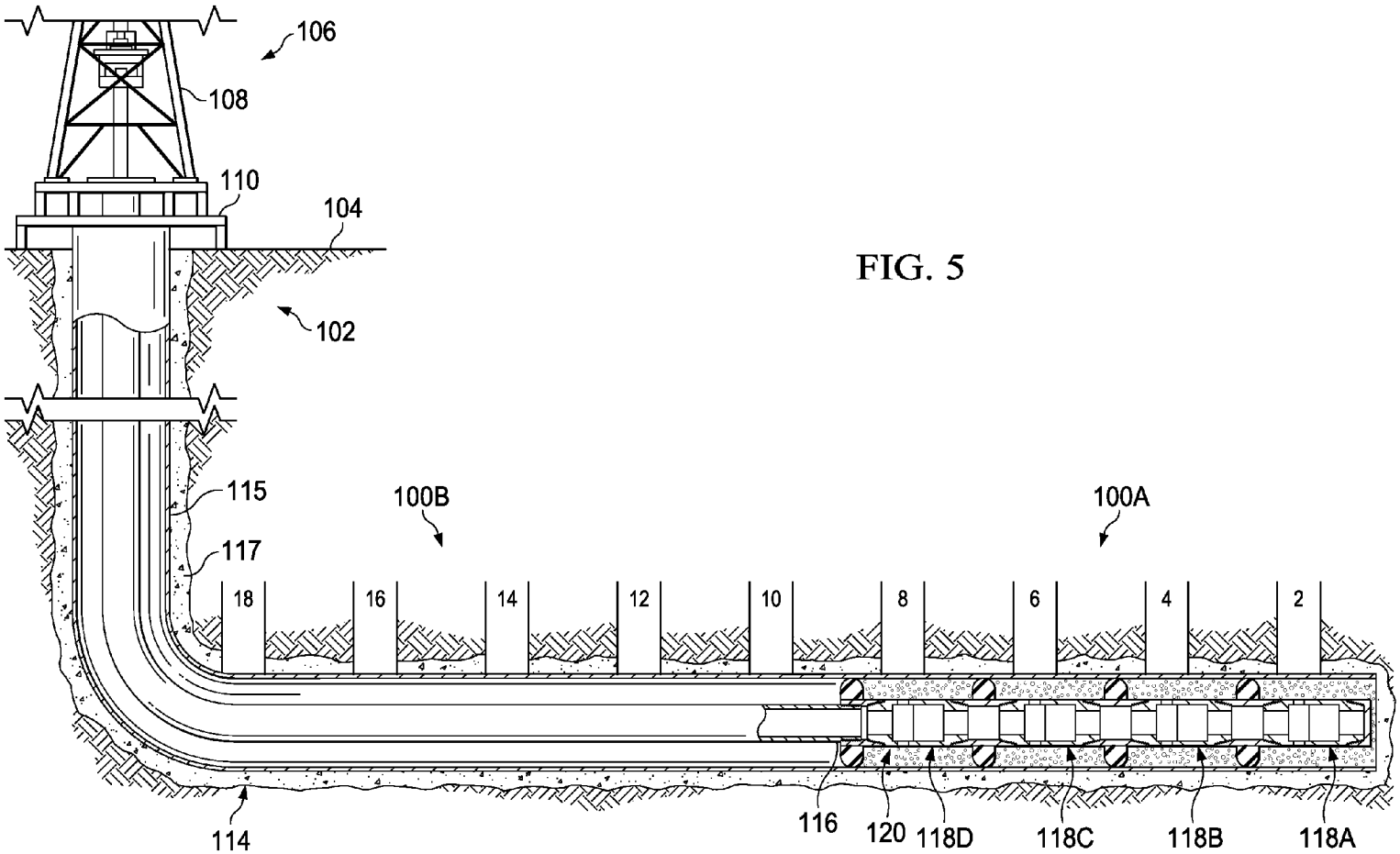
FIG. 5 is a cut-away view of an embodiment of a wellbore penetrating a subterranean formation, the wellbore having a wellbore servicing system detached from a workstring and positioned therein.

In an embodiment, a wellbore servicing method may further comprise disconnecting the first wellbore servicing system 100A from the work string 112. For example, referring to FIG. 5, in an embodiment, following treatment of the zones proximate to the ASAs of the first wellbore servicing system 100A, the connection interface 116 may be actuated (e.g., via any suitable method or apparatus) such that the connection interface 116 ceases to engage the first wellbore servicing system 100A with the work string 112. With the first wellbore servicing system 100A detached form the work string 112, the work string 112 may be removed from the wellbore, while the first wellbore servicing system 100A remains embedded within the wellbore 114.

In an additional embodiment, a wellbore servicing method may further comprise disposing a second wellbore servicing system within the wellbore and treating one or more formation zones via the second wellbore servicing system. For example, referring to FIG. 6, following disconnection of the first wellbore servicing system 100A from the work string 112 and (e.g., via the disengagement of the connection interface 116) and removal of the work string 112 from the wellbore, a second wellbore servicing system 100B may be disposed within the wellbore and connected to the first wellbore servicing system 100A. For example, in the embodiment of FIG. 6, the second wellbore servicing system 100B comprises a tubular string 120 having incorporated therein a fifth ASA 118E, a sixth ASA 118F, a seventh ASA 118G, and an eighth ASA 118H. Also in the embodiment of FIG. 6, the second wellbore servicing system 100B is positioned within the wellbore 114 such that the fifth ASA 118E is proximate and/or substantially adjacent to the fifth subterranean formation zone 10, the sixth ASA 118F is proximate and/or substantially adjacent to the sixth zone 12, the seventh ASA 118G is proximate and/or substantially adjacent to the seventh zone 14, and the eighth ASA 118H is proximate and/or substantially adjacent to the eighth zone 16. Alternatively, any suitable number of ASAs may be incorporated within a tubular string. Also, in an embodiment, the second wellbore servicing system 100B may be connected and/or coupled to the first wellbore servicing system 100A via the operation of the first connection interface 116A. Also, in an embodiment, the second wellbore servicing system 100B may be suspended within the wellbore via a second connection interface 116B. Similarly, in an additional embodiment, a third, fourth, fifth, sixth, or other suitable number of wellbore servicing systems may be disposed within the wellbore and utilized in a subterranean formation treatment operation.

Figure 6:
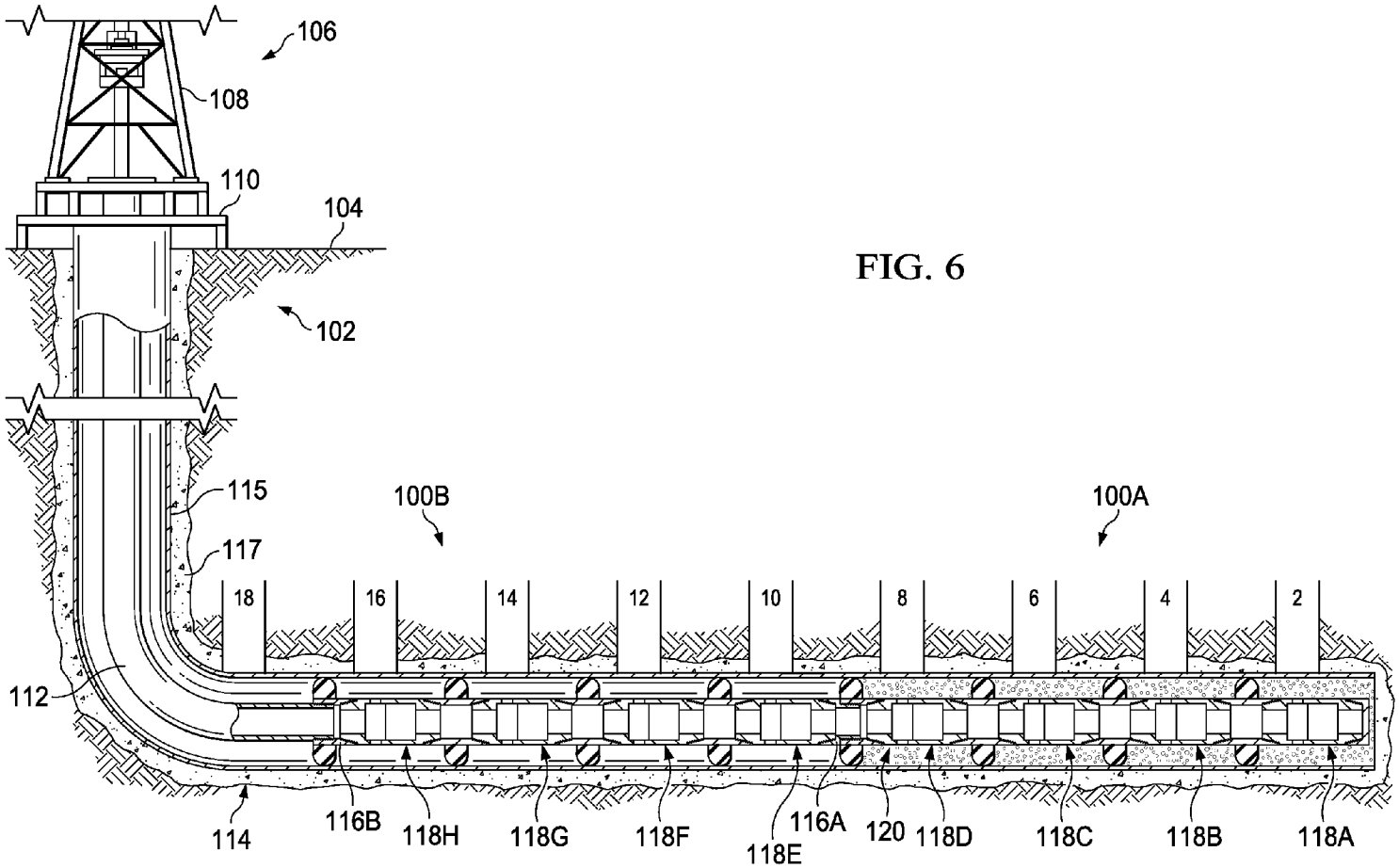
FIG. 6 is a cut-away view of an embodiment of a wellbore penetrating a subterranean formation, the wellbore having two wellbore servicing systems connected to one another via a quick disconnect interface positioned therein.

In an embodiment where a second wellbore servicing system 100B is positioned within the wellbore, for example, as disclosed herein with respect to FIG. 6, the second wellbore servicing system 100B may be used to treat the formation zones proximate thereto. For example, in the embodiment of FIG. 6, the second wellbore servicing system 100B may be used to treat the fifth, sixth, seventh, and eighth formation zones, 10, 12, 14, and 16, respectively, for example, via the fifth, sixth, seventh, and eighth ASAs, 118E, 118F, 118G, and 118H, respectively, as similarly disclosed herein with respect to the first wellbore servicing system.

In an additional embodiment, a wellbore servicing method may further comprise producing a formation fluid from the subterranean formation 102 and/or one or more zones thereof. For example, upon the completion of one of more treatment operations, for example, as disclosed herein, a formation fluid (e.g., oil, gas, water, or combinations thereof) may flow into the wellbore 114, for example, via one or more wellbore servicing systems 100 and to the surface. For example, in such an embodiment, the one or more wellbore servicing systems 100 may serve as a production string or a portion thereof.

In an embodiment, one or more wellbore servicing systems, for example, as disclosed herein, and/or a method using one or more wellbore servicing systems may be advantageously employed in the performance of a wellbore servicing operation. For example, the ability to place a wellbore servicing system having a plurality of ASAs within a wellbore while leaving the annular space open may allow an operator to utilize a composite fluid to treat and/or stimulate the formation. Conversely, where conventional ASAs may be placed within the wellbore and secured (e.g., via cement, packers, or the like), the annular space does not remain open and, as such, an operator does not have the ability to utilize composite fluids in the performance of a servicing operation.

Additional Disclosure

The following are nonlimiting, specific embodiments in accordance with the present disclosure:

A first embodiment, which is a method of servicing a subterranean formation comprising:

placing a wellbore servicing system within a wellbore penetrating the subterranean formation, wherein the wellbore servicing system comprises a first activatable stimulation assembly and a second activatable stimulation assembly incorporated within a tubular string;

configuring the wellbore servicing system to provide a route of fluid communication from the first activatable stimulation assembly to a first zone of the subterranean formation;

introducing a treatment fluid into the first zone of the subterranean formation via the first activatable stimulation assembly; and embedding a first portion of the wellbore servicing system within the wellbore.

A second embodiment, which is the method of the first embodiment, wherein disposing the tubular string within the wellbore comprises:

positioning the first activatable stimulation assembly proximate and/or substantially adjacent to the first formation zone and positioning the second activatable stimulation assembly proximate and/or substantially adjacent to the second formation zone.

A third embodiment, which is the method of one of the first through the second embodiments, wherein the work string further comprises a connection interface.

A fourth embodiment, which is the method of one of the first through the third embodiments, wherein the first activatable stimulation assembly and the second activatable stimulation assembly each comprise a housing defining an axial flowbore comprising one or more ports.

A fifth embodiment, which is the method of the fourth embodiment, wherein each of the first activatable stimulation assembly and the second activatable stimulation assembly further comprise a sliding sleeve, the sliding sleeve being slidably positioned within the housing and transitionable from:

a first position in which the sliding sleeve obstruct fluid communication via the route of fluid communication from the axial flowbore to an exterior of the housing via the one or more ports, to a second position in which the sliding allows fluid communication via the route of fluid communication from the axial flowbore to an exterior of the housing via the one or more ports.

A sixth embodiment, which is the method of the fifth embodiment, wherein shifting the sliding sleeve of the first activatable stimulation assembly from the first position to the second position comprises:

positioning a mechanical shifting tool within the tubular string, wherein the mechanical shifting tool is attached to a work string;

actuating the mechanical shifting tool, wherein actuating the mechanical shifting tool causes the mechanical shifting tool to engage a sliding sleeve of the first activatable stimulation assembly; and moving the sliding sleeve of the first activatable stimulation assembly from the first position to the second position.

A seventh embodiment, which is the method of the fifth embodiment, wherein shifting the sliding sleeve of the first activatable stimulation assembly from the first position to the second position comprises:

introducing an obturating member into the tubular string;

flowing the obturating member through the tubular string to engage the seat within the first activatable stimulation assembly; and applying a fluid pressure to the sliding sleeve of the first activatable stimulation assembly via the obturating member and the seat.

An eighth embodiment, which is the method of one of the first through the seventh embodiments, wherein the treatment fluid comprises a composite treatment fluid, and further comprising forming the composite treatment fluid within the wellbore.

A ninth embodiment, which is the method of the eighth embodiment, wherein forming the composite treatment fluid within the wellbore comprises:

introducing a first fluid component into the wellbore via a first flowpath into the wellbore;

introducing a second fluid component into the wellbore via a second flowpath into the wellbore; and mixing the first component and the second component within the wellbore.

A tenth embodiment, which is the method of the ninth embodiment, wherein the first flowpath into the wellbore comprises an annular space between the tubular string and the wellbore formation and the second flowpath defined by the axial flowbore of the tubing string.

An eleventh embodiment, which is the method of the tenth embodiment, wherein the first fluid component comprises a diluent, wherein the second fluid component comprises a concentrated proppant-laden slurry, and wherein the composite treatment fluid comprises a fracturing fluid.

A twelfth embodiment, which is the method of the eleventh embodiment, wherein the composite treatment fluid is introduced into the first formation zone proximate to the first activatable stimulation assembly.

A thirteenth embodiment, which is the method of the twelfth embodiment, wherein embedding the first portion comprises allowing at least a portion of the composite treatment fluid to become disposed within at least a portion of the annular space between the first activatable stimulation assembly and the wellbore wall.

A fourteenth embodiment, which is the method of one of the first through the thirteenth embodiments, wherein embedding the first portion of the wellbore servicing tool comprises forming a pack of particulate material within at least a portion of an annular space surrounding the first portion of the wellbore servicing tool.

A fifteenth embodiment, which is the method of the fourteenth embodiment, wherein formation of the pack of particulate material is effective to secure the wellbore servicing tool within the wellbore.

A sixteenth embodiment, which is the method of the fourteenth embodiment, where formation of the pack of particulate material is effective to substantially inhibit fluid communication via the portion of the annular space surrounding the first portion of the wellbore servicing tool.

A seventeenth embodiment, which is the method of the twelfth embodiment, further comprising:

deploying a packer between the first formation zone and the second formation zone.

An eighteenth embodiment, which is the method of one of the first through the seventeenth embodiments, further comprising:

providing fluid communication from the second activatable stimulation assembly to a second zone of the subterranean formation;

introducing a treatment fluid into the second zone of the subterranean formation via the second activatable stimulation assembly; and embedding a second portion of the wellbore servicing system within the wellbore.

A nineteenth embodiment, which is the method of the eighteenth embodiment, wherein the wellbore servicing system further comprises a third activatable stimulation assembly incorporated within the tubular string, and further comprising:

providing fluid communication from the third activatable stimulation assembly to a third zone of the subterranean formation;

introducing a treatment fluid into the third zone of the subterranean formation via the third activatable stimulation assembly; and embedding a third portion of the wellbore servicing system within the wellbore.

A twentieth embodiment, which is the method of the seventeenth embodiment, wherein the wellbore servicing system further comprises a fourth activatable stimulation assembly incorporated within the tubular string, and further comprising:

providing fluid communication from the fourth activatable stimulation assembly to a fourth zone of the subterranean formation;

introducing a treatment fluid into the fourth zone of the subterranean formation via the fourth activatable stimulation assembly; and embedding a fourth portion of the wellbore servicing system within the wellbore.

A twenty-first embodiment, which is the method of the third embodiment, wherein the connection interface is configured to selectively couple the wellbore servicing system to a work string.

A twenty-second embodiment, which is the method of the twenty-first embodiment, further comprising disengaging the connection interface, wherein disengaging the connection interfaces renders the wellbore servicing system uncoupled to the work string.

A twenty-third embodiment, which is a wellbore servicing system comprising:

a wellbore servicing system positioned within a wellbore penetrating a subterranean formation, wherein the wellbore servicing system comprises a first activatable stimulation assembly and a second activatable stimulation assembly incorporated within a tubular string, a pack of particulate material disposed within at least a portion of an annular space surrounding the wellbore servicing system, wherein the pack of particulate material is effective to secure the wellbore servicing system within the wellbore, to at least substantially obstruct fluid communication via a the annual space, or combinations thereof.

A twenty-fourth embodiment, which is the wellbore servicing system of the twenty-third embodiment, wherein the annular space is substantially defined by an exterior of the wellbore servicing system and a casing string.

A twenty-fifth embodiment, which is the wellbore servicing system of one of the twenty-third through the twenty-fourth embodiments, wherein the annular space is substantially defined by an exterior of the wellbore servicing system and a wellbore wall.

While embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: $R=Rl+k*(Ru-Rl)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present invention. Thus, the claims are a further description and are an addition to the embodiments of the present invention. The discussion of a reference in the Detailed Description of the Embodiments is not an admission that it is prior art to the present invention, especially any reference that may have a publication date after the priority date of this application. The disclosures of all patents, patent applications, and publications cited herein are hereby incorporated by reference, to the extent that they provide exemplary, procedural or other details supplementary to those set forth herein.

What is claimed is:

1. A method of servicing a subterranean formation comprising:

placing a wellbore servicing system within a wellbore penetrating the subterranean formation, wherein the wellbore servicing system comprises a first activatable stimulation assembly and a second activatable stimulation assembly incorporated within a tubular string;

configuring the wellbore servicing system to provide a route of fluid communication from the first activatable stimulation assembly to a first zone of the subterranean formation;

introducing a treatment fluid into the first zone of the subterranean formation via the first activatable stimulation assembly;

stopping introduction of the treatment fluid into the first zone of the subterranean formation via the first activatable stimulation assembly when the first activatable stimulation assembly is embedded within the wellbore; and introducing the treatment fluid into a second zone of the subterranean formation via the second activatable stimulation assembly when the first activatable stimulation assembly is embedded within the wellbore.

2. The method of claim 1, wherein disposing the tubular string within the wellbore comprises:

positioning the first activatable stimulation assembly proximate and/or substantially adjacent to the first formation zone and positioning the second activatable stimulation assembly proximate and/or substantially adjacent to the second formation zone.

3. The method of claim 1, wherein the tubular string further comprises a connection interface.

4. The method of claim 3, wherein the connection interface is configured to selectively couple the wellbore servicing system to a work string.

5. The method of claim 4, further comprising disengaging the connection interface, wherein disengaging the connection interfaces renders the wellbore servicing system uncoupled to the work string.

6. The method of claim 1, wherein the first activatable stimulation assembly and the second activatable stimulation assembly each comprise a housing defining an axial flowbore comprising one or more ports.

7. The method of claim 6, wherein each of the first activatable stimulation assembly and the second activatable stimulation assembly further comprise a sliding sleeve, the sliding sleeve being slidably positioned within the housing and transitionable from:

a first position in which the sliding sleeve obstruct fluid communication via the route of fluid communication from the axial flowbore to an exterior of the housing via the one or more ports, to a second position in which the sliding allows fluid communication via the route of fluid communication from the axial flowbore to an exterior of the housing via the one or more ports.

8. The method of claim 7, wherein shifting the sliding sleeve of the first activatable stimulation assembly from the first position to the second position comprises:

positioning a mechanical shifting tool within the tubular string, wherein the mechanical shifting tool is attached to a work string;

actuating the mechanical shifting tool, wherein actuating the mechanical shifting tool causes the mechanical shifting tool to engage a sliding sleeve of the first activatable stimulation assembly; and moving the sliding sleeve of the first activatable stimulation assembly from the first position to the second position.

9. The method of claim 7, wherein shifting the sliding sleeve of the first activatable stimulation assembly from the first position to the second position comprises:

introducing an obturating member into the tubular string;

flowing the obturating member through the tubular string to engage the seat within the first activatable stimulation assembly; and applying a fluid pressure to the sliding sleeve of the first activatable stimulation assembly via the obturating member and the seat.

10. The method of claim 1, wherein the treatment fluid comprises a composite treatment fluid, and further comprising forming the composite treatment fluid within the wellbore.

11. The method of claim 10, wherein forming the composite treatment fluid within the wellbore comprises:

introducing a first fluid component into the wellbore via a first flowpath into the wellbore;

introducing a second fluid component into the wellbore via a second flowpath into the wellbore; and mixing the first component and the second component within the wellbore.

12. The method of claim 11, wherein the first flowpath into the wellbore comprises an annular space between the tubular string and the wellbore formation and the second flowpath defined by the axial flowbore of the tubing string.

13. The method of claim 12, wherein the first fluid component comprises a diluent, wherein the second fluid component comprises a concentrated proppant-laden slurry, and wherein the composite treatment fluid comprises a fracturing fluid.

14. The method of claim 13, wherein the composite treatment fluid is introduced into the first formation zone proximate to the first activatable stimulation assembly.

15. The method of claim 14, wherein embedding the first portion comprises allowing at least a portion of the composite treatment fluid to become disposed within at least a portion of the annular space between the first activatable stimulation assembly and the wellbore wall.

16. The method of claim 1, wherein embedding the first portion of the wellbore servicing tool comprises forming a pack of particulate material within at least a portion of an annular space surrounding the first portion of the wellbore servicing tool.

17. The method of claim 16, wherein formation of the pack of particulate material is effective to secure the wellbore servicing tool within the wellbore.

18. The method of claim 16, where formation of the pack of particulate material is effective to substantially inhibit fluid communication via the portion of the annular space surrounding the first portion of the wellbore servicing tool.

19. The method of claim 1, further comprising:

providing fluid communication from the second activatable stimulation assembly to a second zone of the subterranean formation; and embedding a second portion of the wellbore servicing system within the wellbore.

20. The method of claim 19, wherein the wellbore servicing system further comprises a third activatable stimulation assembly incorporated within the tubular string, and further comprising:

providing fluid communication from the third activatable stimulation assembly to a third zone of the subterranean formation;

introducing the treatment fluid into the third zone of the subterranean formation via the third activatable stimulation assembly; and embedding a third portion of the wellbore servicing system within the wellbore.

21. A method of servicing a subterranean formation comprising:

placing a wellbore servicing system within a wellbore penetrating the subterranean formation, wherein the wellbore servicing system comprises a first activatable stimulation assembly and a second activatable stimulation assembly incorporated within a tubular string;

configuring the wellbore servicing system to provide a route of fluid communication from the first activatable stimulation assembly to a first zone of the subterranean formation;

introducing a treatment fluid into the first zone of the subterranean formation via the first activatable stimulation assembly; and embedding a first portion of the wellbore servicing system within the wellbore, wherein the treatment fluid comprises a composite treatment fluid, and further comprising forming the composite treatment fluid within the wellbore;

wherein forming the composite treatment fluid within the wellbore comprises:

introducing a first fluid component into the wellbore via a first flowpath into the wellbore;

introducing a second fluid component into the wellbore via a second flowpath into the wellbore; and mixing the first component and the second component within the wellbore;

wherein the first flowpath into the wellbore comprises an annular space between the tubular string and the wellbore formation and the second flowpath is defined by the axial flowbore of the tubing string;

wherein the first fluid component comprises a diluent, wherein the second fluid component comprises a concentrated proppant-laden slurry, and wherein the composite treatment fluid comprises a fracturing fluid;

wherein the composite treatment fluid is introduced into the first formation zone proximate to the first activatable stimulation assembly; and deploying a packer between the first formation zone and the second formation zone.

22. The method of claim 21, wherein the wellbore servicing system further comprises a fourth activatable stimulation assembly incorporated within the tubular string, and further comprising:

providing fluid communication from the fourth activatable stimulation assembly to a fourth zone of the subterranean formation;

introducing the treatment fluid into the fourth zone of the subterranean formation via the fourth activatable stimulation assembly; and embedding a fourth portion of the wellbore servicing system within the wellbore.

23. A wellbore servicing system comprising:

a wellbore servicing system positioned within a wellbore penetrating a subterranean formation, wherein the wellbore servicing system comprises a first activatable stimulation assembly and a second activatable stimulation assembly incorporated within a tubular string, wherein a treatment fluid is introduced into a first zone of the subterranean formation via the first activatable stimulation assembly;

a pack of particulate material disposed within at least a portion of an annular space surrounding the wellbore servicing system, wherein the pack of particulate material is effective to embed the first activatable stimulation assembly within the wellbore, to at least substantially obstruct fluid communication via the annular space, or combinations thereof;

wherein the treatment fluid is not introduced into the first zone of the subterranean formation via the first activatable stimulation assembly once the first activatable stimulation assembly is embedded within the wellbore; and wherein the treatment fluid is introduced into a second zone of the subterranean formation via the second activatable stimulation assembly once the first activatable stimulation assembly is embedded within the wellbore.

24. The wellbore servicing system of claim 23, wherein the annular space is substantially defined by an exterior of the wellbore servicing system and a casing string.

25. The wellbore servicing system of claim 23, wherein the annular space is substantially defined by an exterior of the wellbore servicing system and a wellbore wall.

* * * * *